US012049898B2

(12) United States Patent
Rao et al.

(10) Patent No.: US 12,049,898 B2
(45) Date of Patent: Jul. 30, 2024

(54) AIR-FLOW CHANNEL STRUCTURE OF AIR PUMP, MICRO AIR PUMP, WATERPROOF AIR PUMP, AND INFLATABLE PRODUCT

(71) Applicant: Jiangsu Guorun Electric Co., Ltd., Huaian (CN)

(72) Inventors: Houxi Rao, Huaian (CN); Jianbing Yin, Huaian (CN); Bing Sun, Huaian (CN)

(73) Assignee: Jiangsu Guorun Electric Co., Ltd., Huaian (CN)

( * ) Notice: Subject to any disclaimer, the term of this patent is extended or adjusted under 35 U.S.C. 154(b) by 85 days.

(21) Appl. No.: 17/941,034

(22) Filed: Sep. 9, 2022

(65) Prior Publication Data

US 2023/0136866 A1 May 4, 2023

(30) Foreign Application Priority Data

Oct. 29, 2021 (CN) ..... 202122624319.X
Oct. 29, 2021 (CN) ..... 202122624337.8
Apr. 28, 2022 (CN) ..... 202221038806.6

(51) Int. Cl.
*F04D 13/06* (2006.01)
*F04D 1/00* (2006.01)
(Continued)

(52) U.S. Cl.
CPC ..... *F04D 13/06* (2013.01); *F04D 1/00* (2013.01); *F04D 29/284* (2013.01); *F04D 29/4206* (2013.01)

(58) Field of Classification Search
CPC ..... F04D 13/06; F04D 13/0606; F04D 1/00; F04D 29/284; F04D 29/4206;
(Continued)

(56) References Cited

U.S. PATENT DOCUMENTS 5,352,089 A * 10/1994 Tokunaga ..... F04D 29/162 415/206
6,155,781 A * 12/2000 Tsai ..... F04D 25/084 416/185
(Continued)

OTHER PUBLICATIONS

Gulich, J. Centrifugal Pumps. Springer: 2010. p. 412-416. (Year: 2010).*

*Primary Examiner* — Juan G Flores
*Assistant Examiner* — Ryan C Clark
(74) *Attorney, Agent, or Firm* — Bayramoglu Law Offices LLC

(57) ABSTRACT

An air-flow channel structure of an air pump, a micro air pump, a waterproof air pump, and an inflatable product are provided. The air-flow channel structure of the air pump includes an air chamber. The air inlet of the air chamber communicates with an axial-direction air inlet of the centrifugal impeller arranged inside the air chamber. The air chamber is formed with an air-guiding wall inside that gradually expands in a spiral shape around an axis of the centrifugal impeller. An air-guiding channel is formed between the air-guiding wall and the centrifugal impeller. A tangent air outlet is provided at the tail end of the air-guiding channel. The micro air pump is configured with the air-flow channel structure of air pump. The waterproof air pump includes a waterproof exterior shell and the micro air pump removably connected to the waterproof exterior shell inside.

18 Claims, 18 Drawing Sheets

(51) Int. Cl.
*F04D 29/28* (2006.01)
*F04D 29/42* (2006.01)

(58) Field of Classification Search
CPC ..... F04D 29/28; F04D 29/281; F04D 29/282; F04D 25/084; F04D 25/068; F04D 13/068; A47C 27/082; F05D 2260/60; F05D 2260/605; F05D 2260/606; F05D 2210/12
See application file for complete search history.

(56) References Cited

U.S. PATENT DOCUMENTS

2001/0026763 A1* 10/2001 Chung ..... F04D 25/0673 417/360
2006/0073040 A1* 4/2006 Metzger ..... F04D 29/281 417/423.1
2007/0253806 A1* 11/2007 Russell ..... F04D 29/4253 415/121.2
2008/0226472 A1* 9/2008 Kanai ..... F04D 25/062 415/206
2011/0083753 A1* 4/2011 Chaffee ..... F04D 25/084 137/223
2011/0180169 A1* 7/2011 Song ..... A47C 27/082 137/861
2012/0114476 A1* 5/2012 Wong ..... F04D 29/4233 415/208.1
2013/0092357 A1* 4/2013 Sato ..... F04D 29/403 415/212.1
2015/0110653 A1* 4/2015 Kim ..... F04D 13/025 417/420
2015/0354584 A1* 12/2015 Iwata ..... F04D 29/281 415/203
2016/0123349 A1* 5/2016 Wang ..... F04D 29/4226 415/175
2016/0215780 A1* 7/2016 Liu ..... F04D 29/503
2018/0283405 A1* 10/2018 Mochizuki ..... F04D 29/708
2019/0128280 A1* 5/2019 Horii ..... F04D 29/4226
2019/0271322 A1* 9/2019 Huang ..... F04D 25/12
2019/0271323 A1* 9/2019 Huang ..... A47C 27/083
2021/0270291 A1* 9/2021 Ichihashi ..... F04D 29/4226

* cited by examiner

AIR-FLOW CHANNEL STRUCTURE OF AIR PUMP, MICRO AIR PUMP, WATERPROOF AIR PUMP, AND INFLATABLE PRODUCT

CROSS REFERENCE TO THE RELATED APPLICATIONS

This application is based upon and claims priority to Chinese Patent Application No. 202122624337.8, filed on Oct. 29, 2021; 202122624319.X, filed on Oct. 29, 2021; 202221038806.6, filed on Apr. 28, 2022, the entire contents of which are incorporated herein by reference.

TECHNICAL FIELD

The present invention relates to the technical field of air pumps, particularly to an air-flow channel structure of an air pump, a micro air pump, a waterproof air pump, and an inflatable product.

BACKGROUND

An air pump is a device used to remove air from or add air to an enclosed space. At present, various inflatable products, such as inflatable mattresses, inflatable trampolines, inflatable sofas, inflatable toys, inflatable boats, inflatable swim rings, inflatable pools, and others, usually use outer air pumps for rapid inflation or aspiration. For outdoor use, it is not convenient for the user to bring an air pump to use, but manual inflation is laborious and time-consuming. Based on the above-mentioned problems, the prior art has provided an inflatable product with a built-in air pump.

An air pump realizes the pumping function by driving the impeller to rotate through an electric motor. The closed impeller in the prior art is equipped with a cover on both sides of the impeller blade, which has a high inflating efficiency, but the manufacturing process is complicated and costly and requires ultrasonic welding of the upper cover. The open impeller in the prior art has no cover on one side of the impeller blade, which can be made by a simple manufacturing process that is less costly and does not require ultrasonic welding, but the inflating efficiency is not as high as that of the closed impeller. In addition, the air pump in the prior art is limited by the impeller structure, requiring additional air-guiding pieces. A utility model patent (Chinese patent No. 201921542896.0) discloses that an electric inflator pump includes a ventilation seat. The ventilation seat is provided with a circle of airflow inlets in the circumferential direction of the ventilation seat. The bottom face of the ventilation seat is provided with a plurality of guide grooves, and the guide grooves communicate with the airflow inlets in a one-to-one correspondence. It is required to set the ventilation seat to achieve air-guiding, which has a complicated structure with many parts. Thus, the overall size of the pump cannot be manufactured to be small. Additionally, it also has drawbacks, such as loud noises, high energy consumption, and low inflating efficiency per unit volume. Therefore, the air pump in the prior art is limited by some factors, such as volume, inflating efficiency, and the like, and cannot be built into small-sized inflatable products, such as an inflatable swim ring.

In addition, in terms of inflatable products that contact water, such as inflatable boats, inflatable swim rings, inflatable pools, and the like, the air pump must be waterproof. If sealing and waterproofing are not sufficient, electric leakage may occur and cause safety hazards. Additionally, the existing built-in air pump can only be used with the inflatable product it is built into rather than being separable from the inflatable product, which does not facilitate charging and maintaining the air pump. Thus, once the air pump is damaged, the inflatable product is discarded simultaneously with the damaged air pump, which limits its use and flexibility. Besides, the existing air pump generally has a complex structure and a cumbersome production process.

SUMMARY

The main objective of the present invention is to overcome the shortcomings of the prior art and provide an air-flow channel structure of an air pump, a micro air pump, a waterproof air pump, and an inflatable product. The air-flow channel structure of the air pump speeds up the flowing of the air and improves the inflating efficiency. It reduces the overall size of the air pump when it is applied in the micro air pump, which meets the requirement for a built-in air pump for small inflatable products. It is convenient to assemble and disassemble the waterproof air pump to facilitate charging, repairing, replacing, and flexibly using the air pump.

The technical solutions in the present invention are as follows.

An air-flow channel structure of an air pump includes a shell body and a centrifugal impeller. The shell body is formed with an air chamber which is configured for accommodating the centrifugal impeller. The centrifugal impeller is arranged inside the air chamber. The air chamber is provided with an air inlet arranged along an axial direction of the centrifugal impeller. The air inlet communicates with an axial-direction air inlet of the centrifugal impeller. The air chamber is formed with an air-guiding wall inside that gradually expands in a spiral shape around an axis of the centrifugal impeller. A gap is provided between the air-guiding wall and the centrifugal impeller, and the gap forms an air-guiding channel. The air-guiding wall expands gradually away from the centrifugal impeller from the head end of the air-guiding channel to the tail end of the air-guiding channel. The air chamber is provided with a tangent air outlet at the tail end of the air-guiding channel. The tangent air outlet communicates with the air-guiding channel and an exterior part of the air chamber. Air flows to the axial-direction air inlet of the centrifugal impeller from the air inlet. The centrifugal impeller radially blows air, and the air flows from the head end of the air-guiding channel to the tail end of the air-guiding channel and flows out of the air chamber from the tangent air outlet.

Further, the shell body includes an impeller mounting seat and an impeller cover. The impeller mounting seat and the impeller cover are sealingly connected. The air chamber is formed between the impeller mounting seat and the impeller cover. The air inlet is arranged on the impeller cover. The impeller mounting seat is provided with a bottom baffle. The air-guiding wall is connected onto the bottom baffle.

Further, the centrifugal impeller includes an upper cover board, a lower cover board, and a plurality of impeller blades that are connected between the upper cover board and the lower cover board. The external diameter of the lower cover board is shorter than the external diameter of the upper cover board.

Further, the external diameter of the lower cover board of the centrifugal impeller is not greater than the diameter of the axial-direction air inlet.

Further, a side, facing towards the axial-direction air inlet of the centrifugal impeller, of the air inlet extends downwards to form an extending edge. A side, facing towards the air inlet, of the axial-direction air inlet of the centrifugal impeller extends upwards to form a ring boss. The extending edge protrudes into the ring boss.

Further, the upper cover board is obliquely arranged gradually upwards from an outer side to an inner side radially. The impeller blades extend to the center shaft from an edge of an outer side of the upper cover board to an inner side and extend upwards to protrude into the ring boss. The upper end surfaces of the impeller blades gradually go upwards obliquely along with the upper cover board, where the impeller blades are located in a section from an edge of an outer side of the upper cover board to the ring boss. The upper end surfaces of the impeller blades gradually go downwards obliquely, where the impeller blades are located in a section from the ring boss to the center shaft.

Further, an air deflecting board is arranged above the tangent air outlet. The air deflecting boards are obliquely arranged from the top to the bottom along with the direction of air flowing out.

Further, the impeller cover is provided with a step that matches an outline of the air-guiding wall. The surface of the step has a flared shape that concaves from the outer circumference toward the center.

A micro air pump includes the air-flow channel structure of the air pump.

Further, the micro air pump further includes an air pump exterior shell and an electric motor. The electric motor is connected to and drives the centrifugal impeller to rotate. The shell body is provided in the air pump exterior shell or is a part of the air pump exterior shell. The air pump exterior shell is provided with a first air inlet and a first air outlet. One end of the air inlet of the air chamber communicates with the first air inlet of the air pump exterior shell, and the tangent air outlet communicates with the first air outlet of the air pump exterior shell.

Further, the micro air pump is further provided with a ventilating hole, and the ventilating hole is configured to communicate with the first air outlet and the outside and to provide an air inlet/outlet channel.

Further, the impeller mounting seat is provided with the ventilating hole on the exterior side of the air-guiding wall.

Further, the impeller cover extends upwards to form an air inlet sidewall at the air inlet, and the air inlet sidewall is provided with the ventilating hole.

Further, the electric motor is a coreless electric motor.

Further, the air pump exterior shell includes an air pump lower shell and an air pump upper cover. The first air inlet is provided on the air pump upper cover. The first air outlet is arranged on the air pump lower shell. The shell body is provided inside the air pump exterior shell. The air pump lower shell, the air pump upper cover, and the impeller mounting seat are removably assembled with each other in a limiting and clamping manner. The impeller mounting seat and the impeller cover are removably assembled with each other in the limiting and clamping manner.

Further, the micro air pump further includes a circuit board. The circuit board is electrically connected to the electric motor. The upper end of the impeller cover is formed with a circuit board mounting frame. The circuit board is position-limited and clamped on the circuit board mounting frame. A gap for the air to flow in is positioned between the circuit board and the air inlet of the impeller cover.

Further, the micro air pump is an inflator pump or an aspirator pump.

A waterproof air pump includes a waterproof exterior shell and the micro air pump removably connected to the waterproof exterior shell inside. The waterproof exterior shell includes a lower shell body and a waterproof upper cover. The lower shell body is removably connected to and relatively sealed with the waterproof upper cover. The micro air pump is removably connected to the lower shell body. The lower shell body is formed with a second air outlet. The second air outlet communicates with the first air outlet of the micro air pump.

Further, the lower shell body is connected to or fastened with the waterproof upper cover by a thread or a screw fastening assembly. The lower shell body is also connected to or fastened with the micro air pump by a thread or a screw fastening assembly.

An inflatable product includes the inflatable product body and the waterproof air pump. The exterior wall of the lower shell body is sealingly connected to the inflatable product body. The second air outlet is located in an interior cavity of the inflatable product body. The waterproof upper cover is exposed on an exterior part of the inflatable product body.

Based on the above description of the present invention and compared with the prior art, the advantages of the present invention are as follows.

Firstly, the air-flow channel structure of the air pump in the present invention is provided with the air-guiding wall that gradually expands in a spiral shape around the axis of the centrifugal impeller, which forms the increasingly wider air-guiding channel. The head end of the air-guiding channel blocks the circular flow of airflow and guides the air blown out radially from the centrifugal impeller to flow along the air-guiding channel. Under the guidance of the air-guiding channel, most of the air can flow out of the air chamber from the tangent air outlet located at the tail end of the air-guiding channel. Therefore, the airflows are guided more smoothly, the flowing speed of the air is faster, and the inflating/aspirating efficiency is higher. In addition, by arranging the oblique air deflecting board above the tangent air outlet, performances concerning guiding and gathering the air have been improved, and the airflows are guided to flow out of the air chamber from the tangent air outlet more smoothly and efficiently. The flow of the air is further speeded up, and the inflating/aspirating efficiency is further improved.

Secondly, the external diameter of the lower cover board of the centrifugal impeller is shorter than the diameter of the upper cover board, so compared to open impellers, the centrifugal impeller in the present invention configures airflow along a preset path better to improve the inflating/aspirating efficiency. Meanwhile, the external diameter of the lower cover board of the centrifugal impeller is no greater than the diameter of the axial-direction air inlet, which can be integrally molded using molds without the requirements of additional welding or bonding processes to simplify the manufacturing process and economize on costs. Furthermore, compared to closed impellers, the centrifugal impeller in the present invention is more convenient to process and manufacture with a lower cost.

Thirdly, in the present invention, an air-guiding channel is formed by the centrifugal impeller fitted with the air-guiding wall, and the air-flow channel structure is compact to reduce the overall size of the micro air pump. In addition, since the coreless electric motor has the advantages of being lightweight and small in size and having low energy consumption, a fast response, a small fluctuation of rotating speed, and low noise levels, the present invention uses a coreless electric motor in the air pump to further reduce the overall size of the micro air pump and make it more portable so that the micro air pump can achieve an inflating/aspirating efficiency that cannot be achieved by an air pump with an electric motor of the same power based on such a small size and can meet the requirements of a built-in air pump for small inflatable products.

Fourth, the side, facing towards the axial-direction air inlet of the centrifugal impeller, of the air inlet of the air chamber extends downwards to form the extending edge. The side, facing towards the air inlet of the air chamber, of the axial-direction air inlet of the centrifugal impeller extends upwards to form the ring boss. The extending edge protrudes into the ring boss. As a result, the air entering the air inlet can be directly guided into an interior part of the air chamber and into the centrifugal impeller to avoid air leaving the air chamber caused by the air leakage from a side of the air inlet of the centrifugal impeller when the air enters the air inlet of the centrifugal impeller and to enhance air-intaking pressure.

The surface of the step of the impeller cover forms the flared shape that concaves from the outer circumference towards the center, which benefits the process of guiding the air to the centrifugal impeller.

The upper cover board on the impeller blades is obliquely arranged gradually upwards from an outer side to an inner side radially. The impeller blades extend to the center shaft from an edge of an outer side of the upper cover board to an inner side and extend upwards to protrude into the ring boss. The upper end surfaces of the impeller blades gradually go upwards obliquely along with the upper cover board, where the impeller blades are located in a section from an edge of an outer side of the upper cover board to the ring boss. The upper end surfaces of the impeller blades gradually go downwards obliquely, where the impeller blades are located in a section from the ring boss to the center shaft. The above oblique structure facilitates the guiding of the air. Specifically, after air enters from the axial-direction air inlet of the impeller, it can flow rapidly downward under the guidance of the impeller blades that are located in a downwards oblique section of an interior side of the ring boss and then flow out radially from the centrifugal impeller. The air is prevented from leaving the axial-direction air inlet of the impeller, and the effective flow of air is accelerated.

Fifth, the ventilating hole is arranged and configured to provide an air inlet/outlet channel. In an inflating process of the air pump, when the inflatable product reaches an air-saturated state, and the air pump is not turned off in time resulting in the inflatable product continuing inflating, it may cause the inflatable product to burst due to over-saturation. Thus, by arranging the ventilating hole, the present invention enables excessive air to exit from the ventilating hole under air pressure, avoiding damage to the inflatable product caused by not turning off the air pump in time. In an aspirating process of the air pump, when the air inside the inflatable product has been all pumped out and the air pump is not turned off in time resulting in continued pumping of the inflatable product, the air inlet may be blocked and damage to the electric motor and the circuit board may occur due to the increase in temperature. At this time, a small amount of air can enter through the ventilating hole to maintain the pumping circulation, avoiding damage to the motor and the circuit board.

Sixth, the micro air pump is provided with the air pump lower shell and the air pump upper cover. The air inlet is provided on the air pump upper cover; the air outlet is arranged on the air pump lower shell. The circuit board is arranged beneath the air pump upper cover through the circuit board mounting frame. The arrangements facilitate arranging a control panel on the air pump upper cover, and the air pump upper cover is exposed outside when the micro air pump is arranged inside the inflatable product. It is convenient to control and facilitate air flowing in. Additionally, the air pump lower shell, the air pump upper cover, the impeller mounting seat, and the impeller cover are removably assembled with each other in a limiting and clamping manner, which simplifies the production process, improves the efficiency of product assembling, and facilitates maintenance and parts replacement.

Seventh, in the waterproof air pump of the present invention, the lower shell body and the waterproof upper cover are sealingly connected, achieving effective waterproofing and anti-air leakage. The micro air pump can be disassembled and separated integrally from the waterproof exterior shell, which facilitates charging, maintenance, and replacement of the micro air pump. One micro air pump can be configured with a plurality of inflatable products to use and inflate various inflatable products by connecting an air nozzle, which makes the micro air pump flexible and convenient to use and reduces costs. Meanwhile, thread connection, screw fastening connection, and other quick connection methods are adopted to connect the lower shell body with the waterproof upper cover and connect the micro air pump with the lower shell body, such that it is convenient and quick to assemble and disassemble, the connection between parts is stable, and the manufacturing difficulties are reduced.

Figure 1:
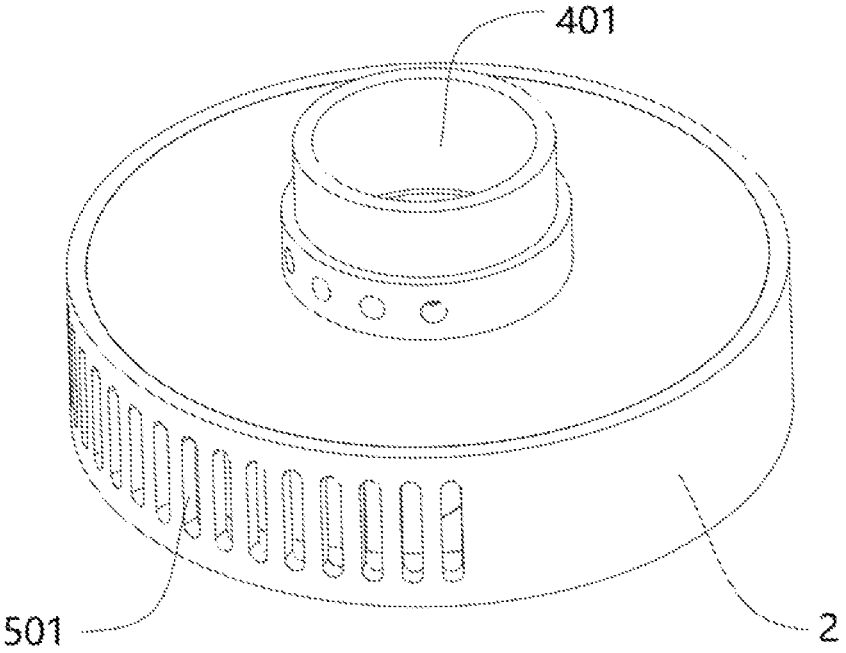
FIG. 1 is a perspective view showing a partial structure of a micro air pump according to Embodiment I of the present invention.
Figure 2:
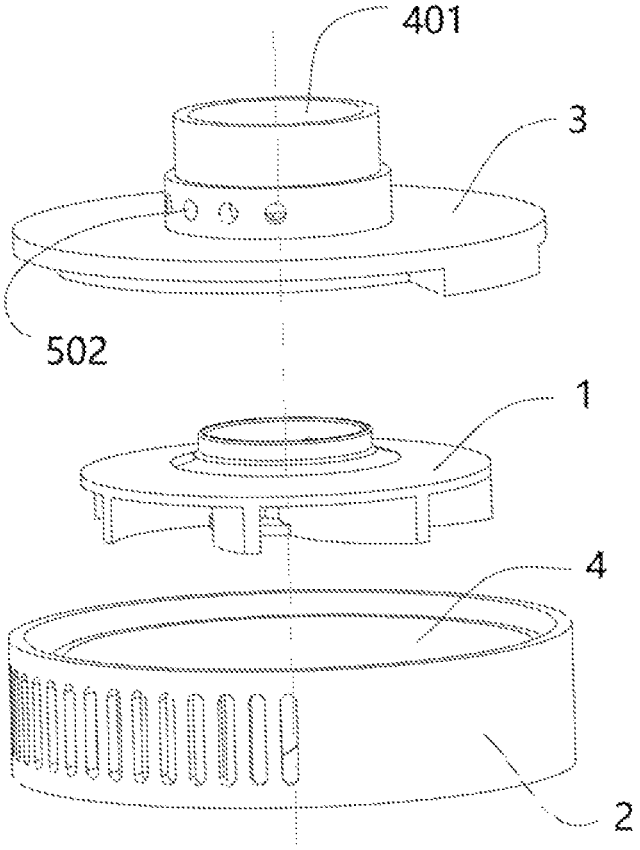
FIG. 2 is an exploded view of the micro air pump according to Embodiment I of the present invention.
Figure 3:
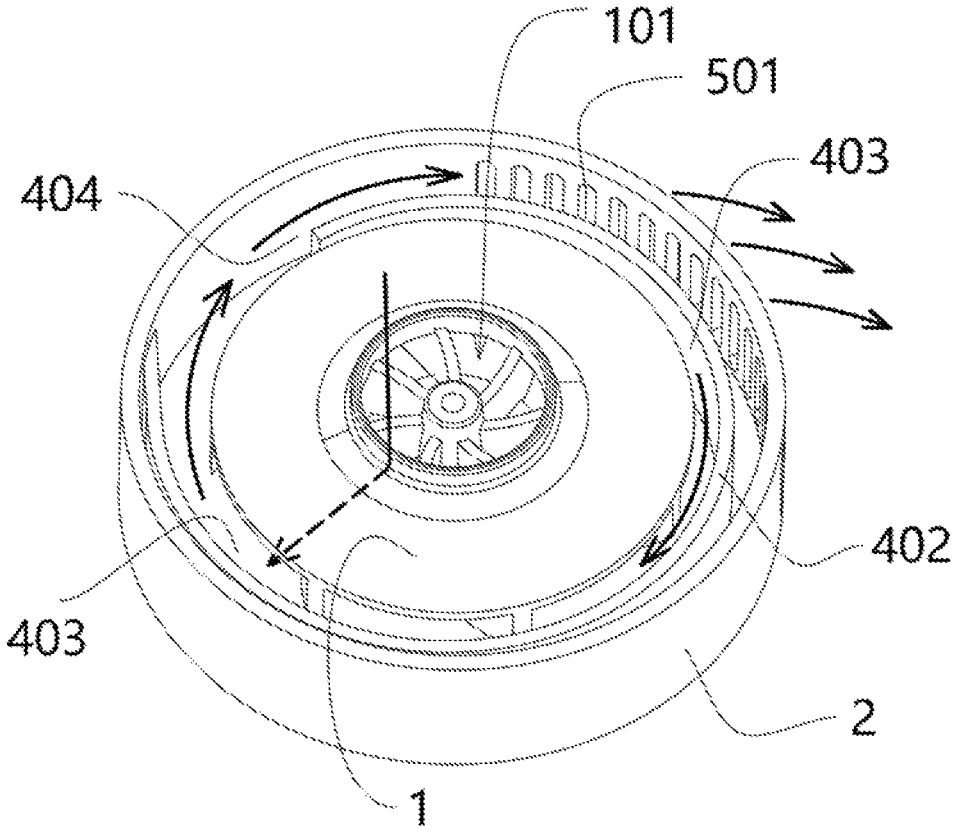
FIG. 3 is a perspective view showing a mounting structure of an impeller mounting seat and a centrifugal impeller according to Embodiment I of the present invention.
Figure 4:
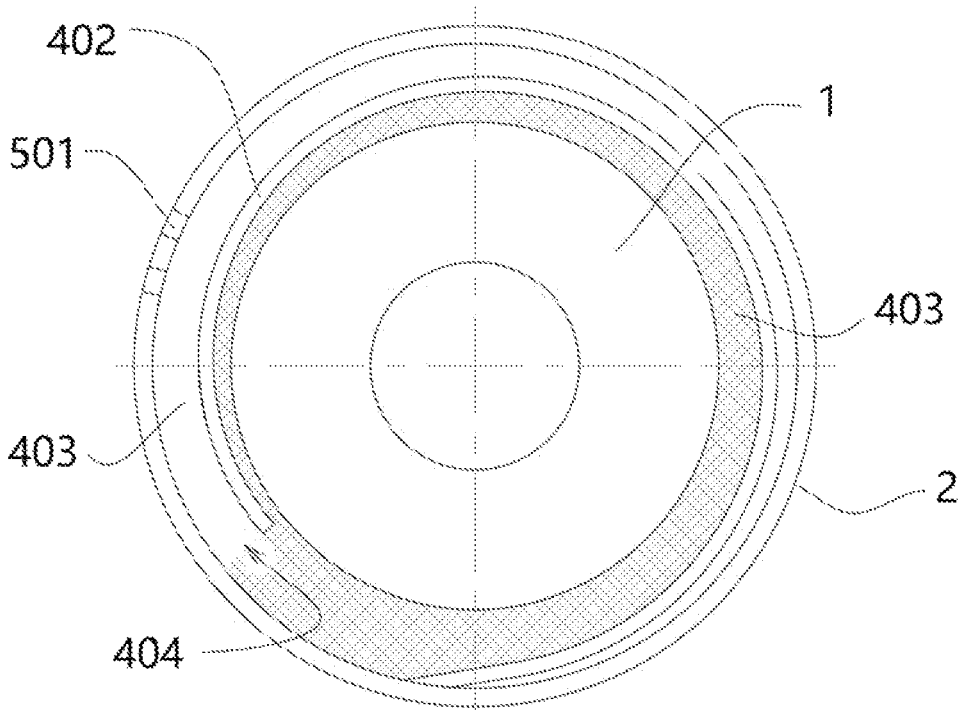
FIG. 4 is a top view showing the mounting structure of the impeller mounting seat and the centrifugal impeller according to Embodiment I of the present invention.
Figure 5:
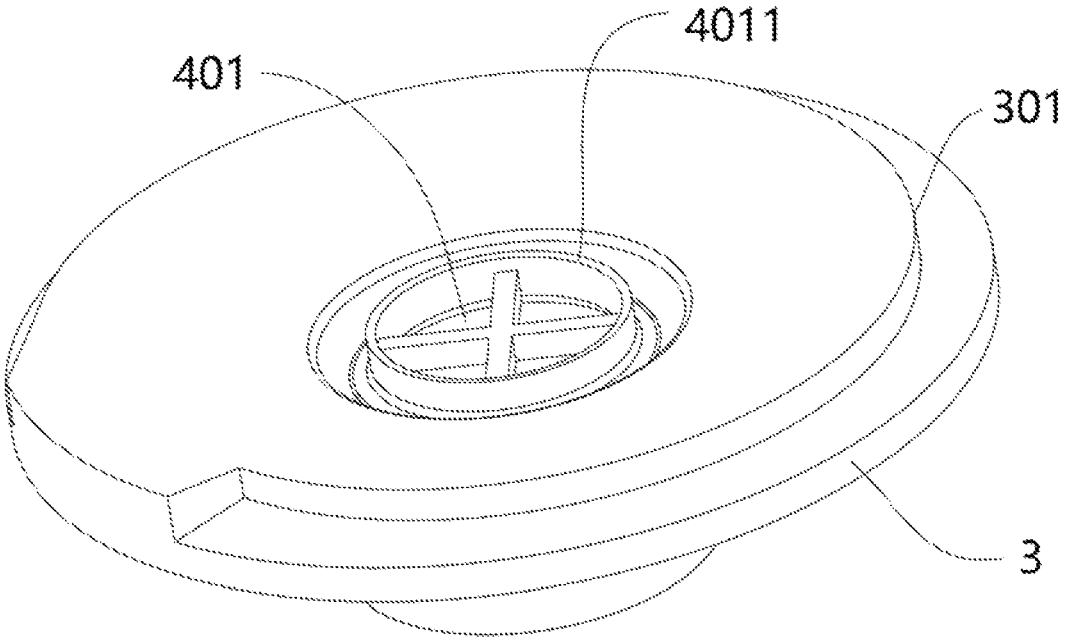
FIG. 5 is a perspective view showing a structure of an impeller cover according to Embodiment I of the present invention.
Figure 6:
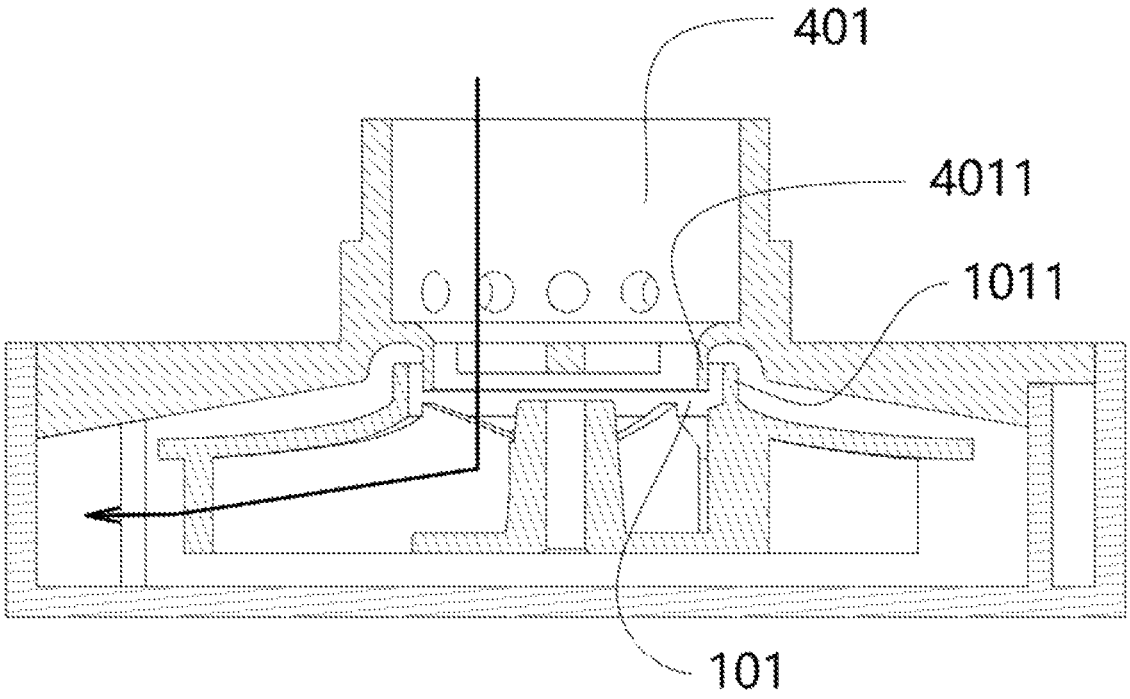
FIG. 6 is a cross-sectional view of the micro air pump according to Embodiment I of the present invention.

In the drawings: 1. centrifugal impeller, 101. axial-direction air inlet, 1011. ring boss, 102. upper cover board, 103. lower cover board, 104. impeller blade, 105. center shaft, 1051. center shaft hole; 2. impeller mounting seat, 201. bottom baffle, 202. electric motor mounting slot, 203. second lug, 204. first position-limiting block, 205. second position-limiting block; 3. impeller cover, 301. step, 302. circuit board mounting frame, 303. stopper, 304. position-limiting slot; 4. air chamber, 401. air inlet, 4011. extending edge, 402. air-guiding wall, 403. air-guiding channel, 404. tangent air outlet, 405. air deflecting board; 5. air pump exterior shell, 501. first air outlet, 502. ventilating hole, 503. assembly chamber, 504. air pump lower shell, 5041. first lug, 5042. second concave port, 5043. first fastening member, 505. air pump upper cover, 5051. first concave port, 5052. position-limiting inserting tab, 506. first air inlet, 507. electric motor locking plate, 508. supporting rod, 509. position-limiting board; 6. electric motor, 7. lithium battery, 8. circuit board, 81. through hole; 9. waterproof exterior shell, 901. lower shell body, 9011. second air outlet, 9012. exterior thread, 9013. first guiding chute, 9014. groove, 9015. fused edge connecting slot seat, 9016. second guiding chute, 902. waterproof upper cover, 9021. interior thread, 9022. clamping slot, 9023. second fastening member; 10. one-way sealing valve piece, 11. flat sealing surface, 12. seal ring, 13. ventilating slot, 14. inflatable swim ring, 141. manual inflation and deflation valve, 15. fused edge, 151. clamping block, 16. switch button, 17. charging port.

DETAILED DESCRIPTION OF THE EMBODIMENTS

As follows, the present invention is further described with specific embodiments.

Embodiment I

As shown in FIGS. 1 to 9, the present invention provides an air-flow channel structure of an air pump. The air-flow channel structure of the air pump includes the shell body and the centrifugal impeller 1. The shell body includes the impeller mounting seat 2 and the impeller cover 3. The impeller mounting seat 2 and the impeller cover 3 are sealingly connected. The air chamber 4 that is configured to be provided with the centrifugal impeller is formed between the impeller mounting seat 2 and the impeller cover 3. The centrifugal impeller 1 is arranged in the air chamber 4. The air inlet 401 of the air chamber 4 is arranged along an axial direction of the centrifugal impeller 1 on the impeller cover 3. The air inlet 401 communicates with the axial-direction air inlet 101 of the centrifugal impeller 1. The impeller mounting seat 2 is provided with the bottom baffle 201. Above the bottom baffle 201, the air chamber 4 is connected to the air-guiding wall 402 that gradually expands in a spiral shape around the axis of the centrifugal impeller 1. The air-guiding wall 402 is arranged perpendicular to the bottom baffle 201. A gap is provided between the air-guiding wall 402 and the centrifugal impeller 1, and the gap forms the air-guiding channel 403. The air-guiding wall 402 expands gradually away from the centrifugal impeller 1 from the head end of the air-guiding channel 403 to the tail end of the air-guiding channel 403. The air chamber 4 is provided with the tangent air outlet 404 at the tail end of the air-guiding channel 403. The tangent air outlet 404 communicates with the air-guiding channel 403 and an exterior part of the air chamber 4. Air flows to the axial-direction air inlet 101 of the centrifugal impeller 1 from the air inlet 401. The centrifugal impeller 1 radically blows air, and the air flows from the head end of the air-guiding channel 403 to the tail end of the air-guiding channel 403 and flows out of the air chamber 4 from the tangent air outlet 404.

The air-flow channel structure of the air pump in the present invention is provided with the air-guiding wall 402 that gradually expands in a spiral shape around the axis of the centrifugal impeller 1, which forms the increasingly wider air-guiding channel 403. The head end of the air-guiding channel 403 is configured to block the circular flow of airflows and guides the air blown out radically from the centrifugal impeller 1 to flow along the air-guiding channel 403. Under the guidance of the air-guiding channel 403, most of the airflows can flow out of the air chamber 4 from the tangent air outlet 404 located at the tail end of the air-guiding channel 403. The airflows are guided more smoothly, resulting in a faster flowing speed of the air and a higher inflating/aspirating efficiency.

The side, facing towards the axial-direction air inlet 101 of the centrifugal impeller 1, of the air inlet 401 extends downwards to form the extending edge 4011. The side, facing towards the air inlet 401, of the axial-direction air inlet 101 of the centrifugal impeller 1 extends upwards to form the ring boss 1011. The extending edge 4011 protrudes into the ring boss 1011. That is, the extending edge 4011 and the ring boss 1011 have an interleaved nesting arrangement, where the formed labyrinth structure can better prevent air from leaving the air inlet 401.

The impeller cover 3 is provided with the step 301 that matches the outline of the air-guiding wall 402. The surface of the step 301 is a flared shape that concaves from the outer circumference towards the center, which assists the air-guiding channel 403 to operate, improving the performance of the air-guiding channel 403 in guiding and gathering the air flows to the centrifugal impeller 1.

Figure 7:
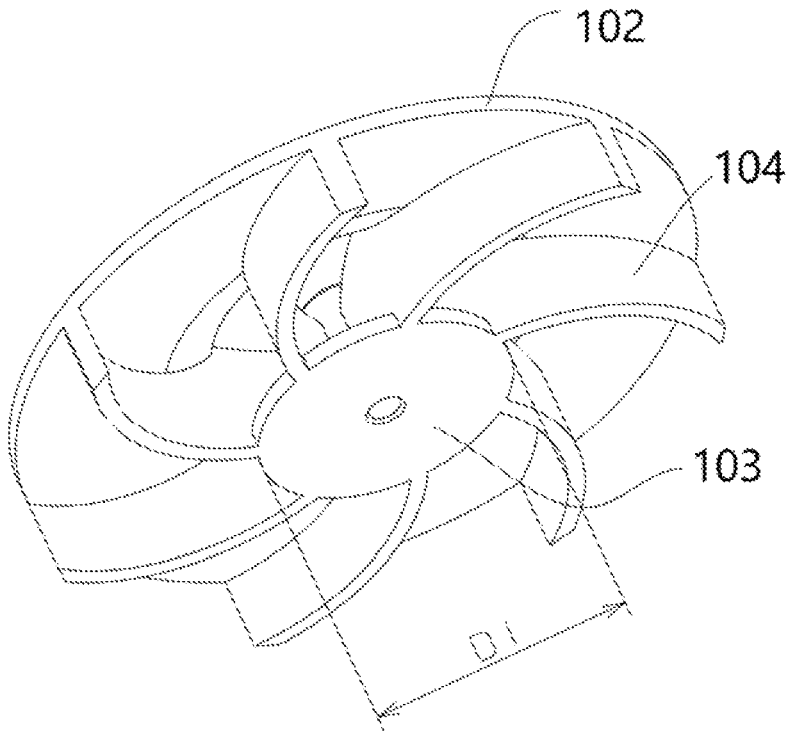
FIG. 7 is a perspective view of the centrifugal impeller according to Embodiment I of the present invention at a first angle of view.
Figure 8:
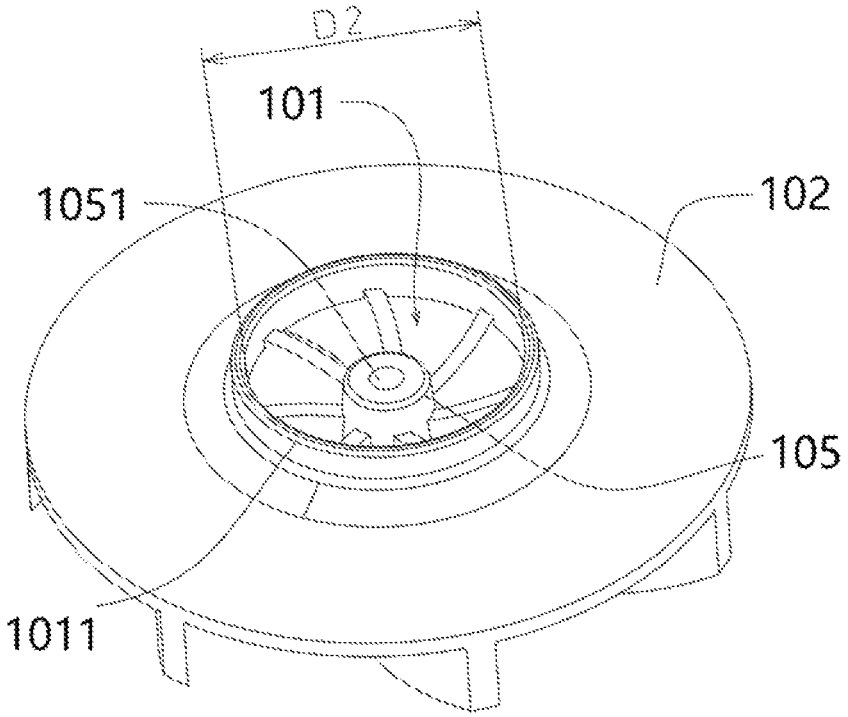
FIG. 8 is a perspective view of the centrifugal impeller according to Embodiment I of the present invention at a second angle of view.
Figure 9:
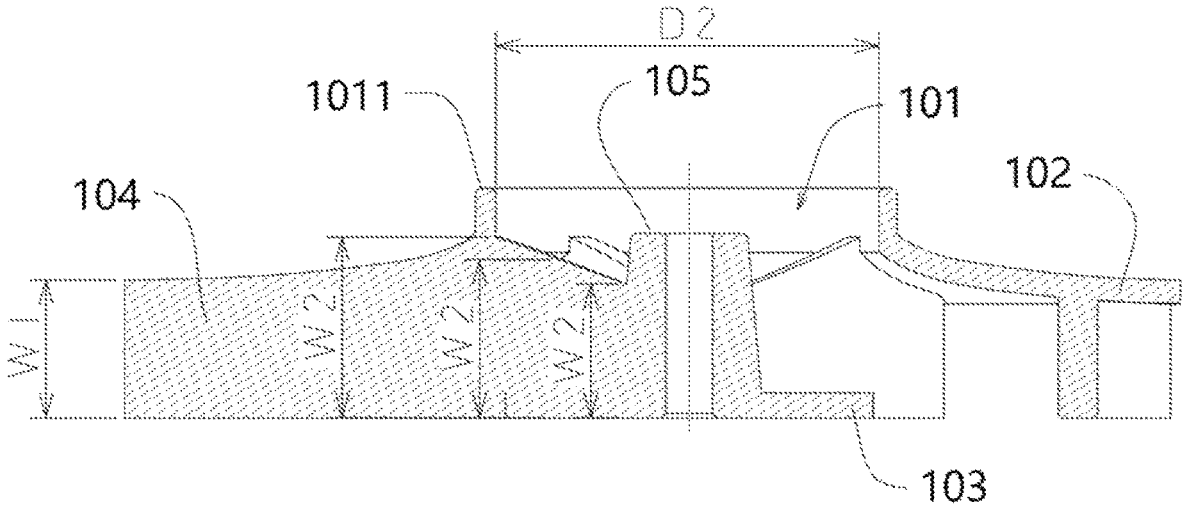
FIG. 9 is a cross-sectional view of the centrifugal impeller according to Embodiment I of the present invention.

As shown in FIGS. 7 to 9, the centrifugal impeller 1 includes the upper cover board 102, the lower cover board 103, and a plurality of impeller blades 104 that are connected between the upper cover board 102 and the lower cover board 103. The center of the centrifugal impeller 1 is provided with the center shaft 105, and the center of the center shaft 105 is formed with the center shaft hole 1051 which is configured to connect an electric motor. The external diameter D1 of the lower cover board 103 is smaller than the external diameter of the upper cover board 102. Compared to open impellers, the centrifugal impeller in the present invention makes the airflows to flow along a preset path better, which improves the inflating/aspirating efficiency. Compared to closed impellers, the centrifugal impeller in the present invention is more convenient to process and manufacture in a less costly manner. The external diameter D1 of the lower cover board 103 of the centrifugal impeller 1 is no more than the diameter D2 of the axial-direction air inlet 101, which can be integrally molded by molds without additional welding or bonding processes, thus simplifying the process and reducing costs.

The upper cover board 102 is obliquely arranged gradually upwards from the outer side to the inner side radically. The impeller blades 104 extend to the center shaft from an edge of an outer side of the upper cover board 102 to the inner side and extend upwards to protrude into the ring boss 1011. Upper end surfaces of the impeller blades 104 gradually go upwards obliquely along with the upper cover board 102, where the impeller blades 104 are located in a section from the edge of the outer side of the upper cover board 102 to the ring boss 1011. Upper end surfaces of the impeller blades 104 gradually go downwards obliquely, where the impeller blades 104 are located in a section from the ring boss 1011 to the center shaft 105. The widths W2, located in the section from the ring boss 1011 to the center shaft 105, of the impeller blades 104 is larger or partially larger than the widths W1, located in a section from the edge of the outer side of the upper cover board 102 to the ring boss 1011 and hidden under the upper cover board 102, of the impeller blades 104, and W1 and W2 is also varying. Different from the closed impellers in prior art, the impeller in the present invention is further provided with the impeller blades 104 at the axial-direction air inlet 101, where the air flows in from the axial-direction air inlet 101 and is blown out by the impeller blades 104. Simultaneously, the lower cover board 103 gathers the air to ensure that the air does not exit from underneath. When centrifugal force is in action, the air will be exhausted out radically from the centrifugal impeller 1 under the centrifugal force even when the lower cover board 103 is not fully covering the impeller blades 104. The oblique structure of the impeller blades 104 is also beneficial for guiding the air flows. Because different air pressures are generated by different blade widths, air enters in from the axial-direction air inlet 101 of the impeller, flows fast downwards under the guidance from the impeller blades 104 in the downwards oblique section in the inner side of the ring boss 1011, and flows out radically from the centrifugal impeller 1, which prevents the air from leaving the axial-direction air inlet 101 of the impeller and speeds up efficient flows of the air.

In this embodiment, the centrifugal impeller 1 is an integrally molded plastic impeller that coordinates with a direct current (DC) motor. It has characteristics, such as lightweight and low cost.

As shown in FIGS. 1 to 6, the present invention provides a micro air pump. The micro air pump is specifically an aspirating pump and further includes the electric motor (the electric motor is not shown). The electric motor is connected to and drives the centrifugal impeller 1 to rotate by the center shaft hole 1051. The sidewall of the impeller mounting seat 2 is provided with the first air outlet 501 to communicate with the tangent air outlet 404. The impeller cover 3 extends upwards to form an air inlet sidewall at the air inlet 401.

The air inlet sidewall is provided with the ventilating hole 502. The ventilating hole 502 is configured to communicate with the first air outlet 501 and the outside and to provide an air inlet channel. In an aspirating process of the air pump, when the air inside the inflatable product has been completely pumped out and the air pump is not turned off in time resulting in its continued pumping, the air inlet 401 may be blocked. At this time, a small amount of air can enter through the ventilating hole 502 to maintain the pumping circulation, thus avoiding damage to the electric motor and the circuit board due to the temperature increase.

Embodiment II

Figure 10:
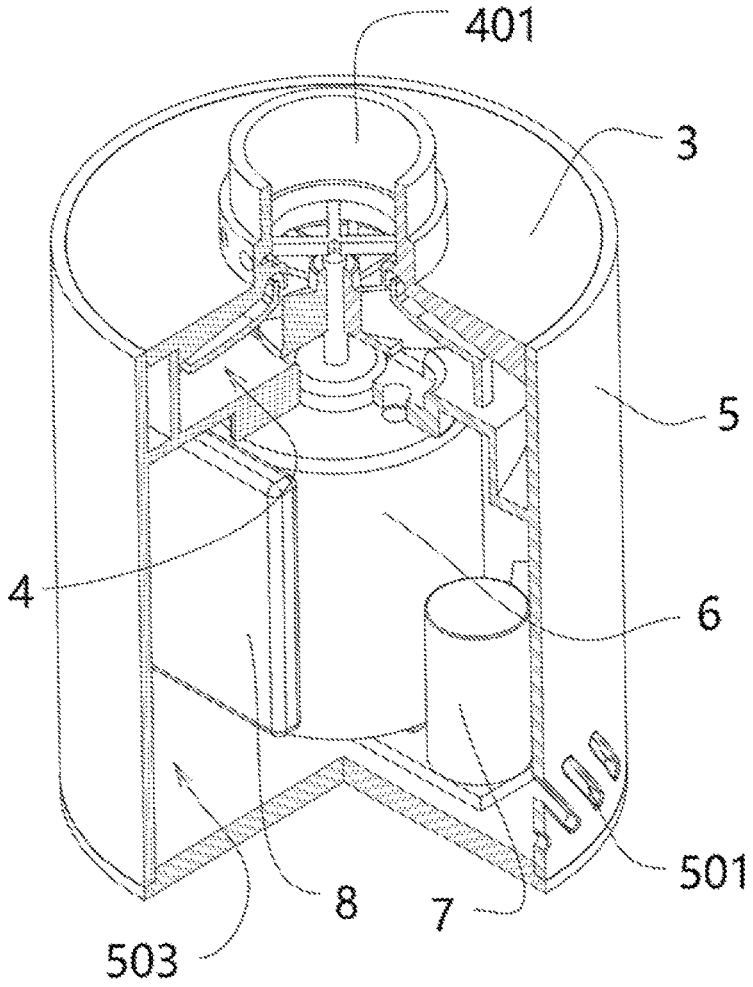
FIG. 10 is a cutaway view of a micro air pump according to Embodiment II of the present invention.
Figure 11:
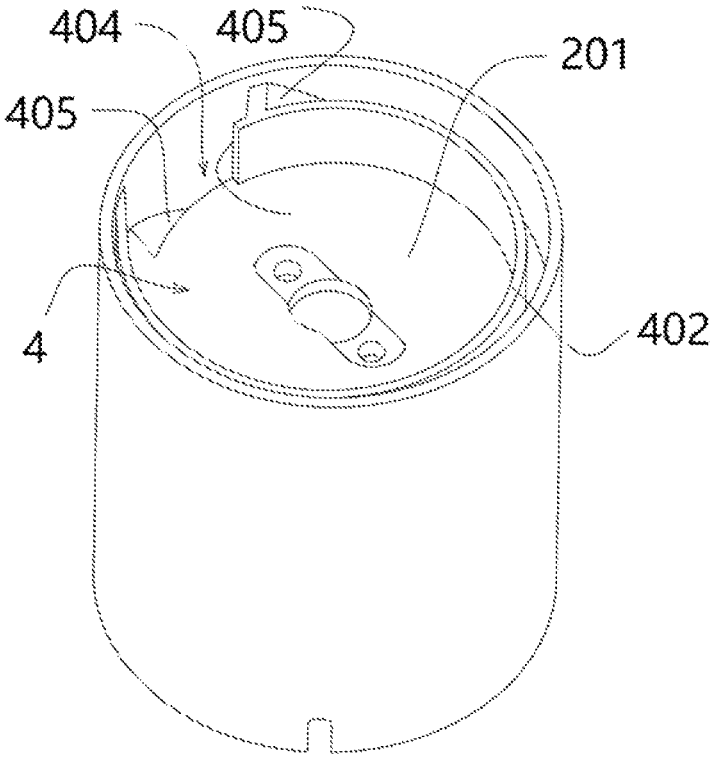
FIG. 11 is a perspective view showing a partial structure of the micro air pump according to Embodiment II of the present invention.
Figure 12:
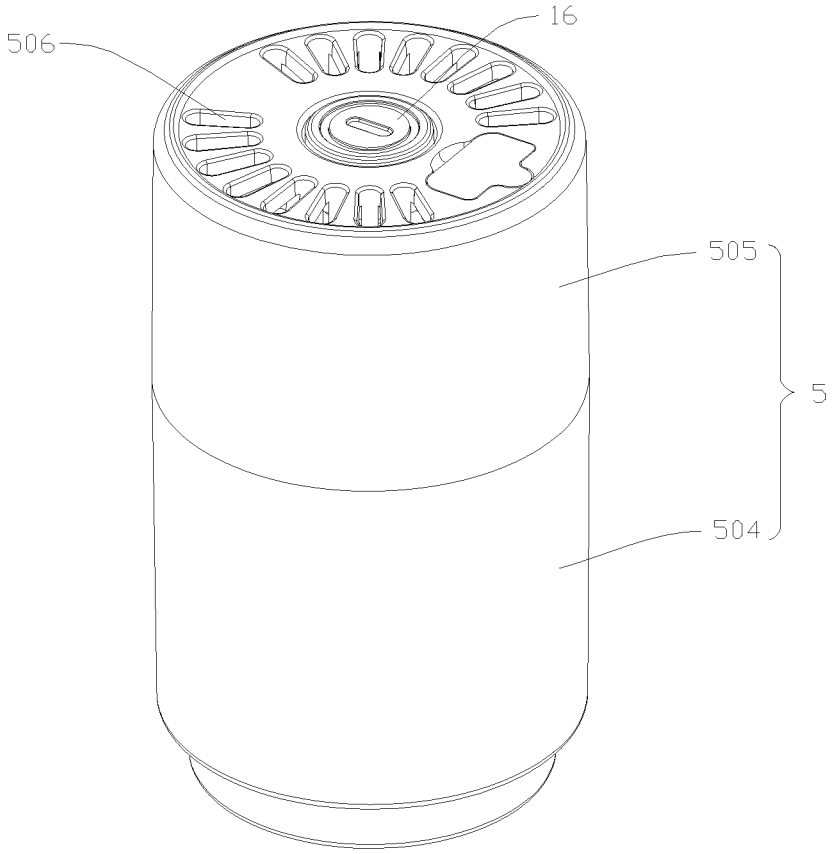
FIG. 12 is a perspective view showing a mounting structure of a micro air pump according to Embodiment III of the present invention at a first angle of view.
Figure 13:
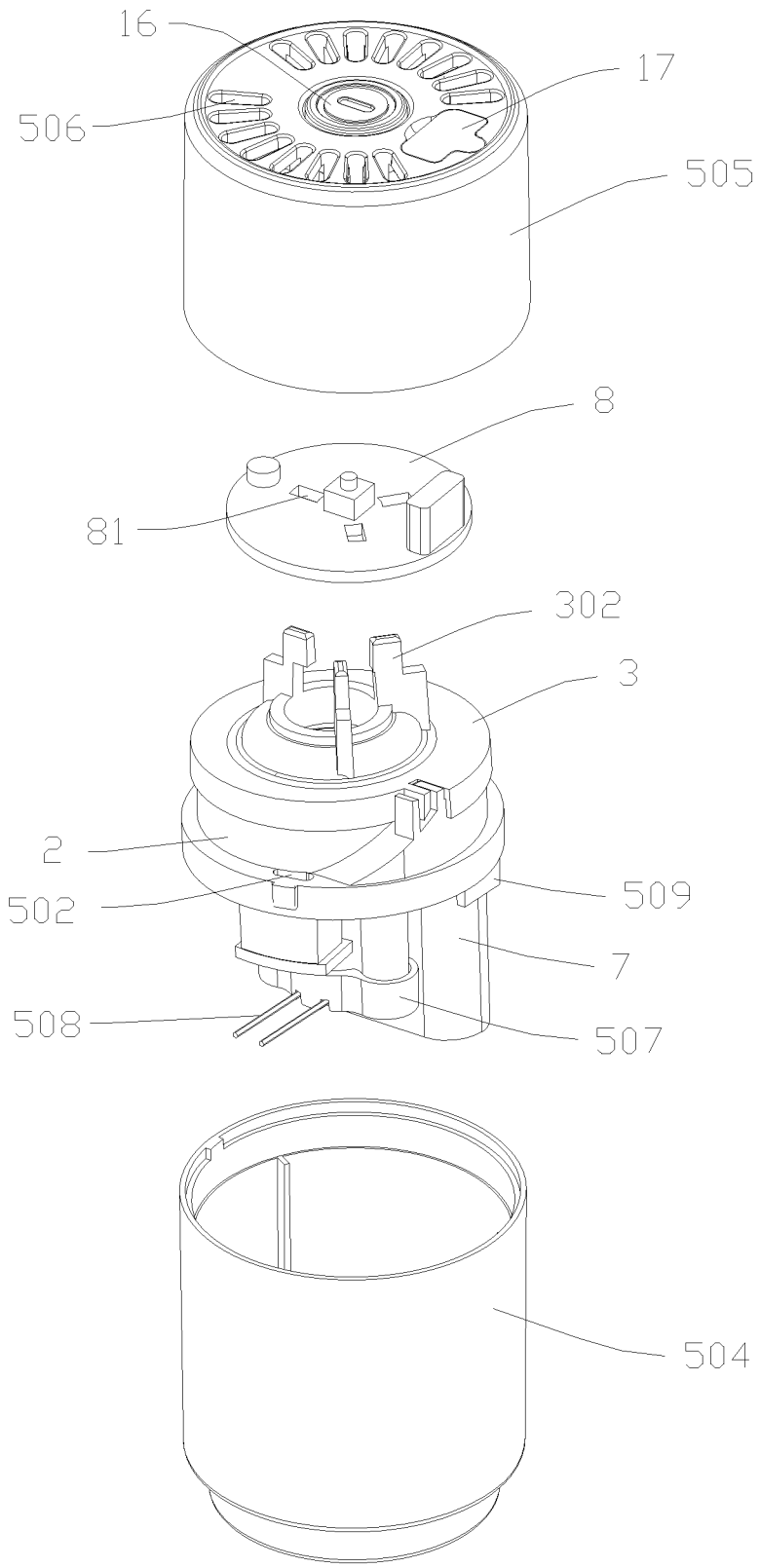
FIG. 13 is an exploded view of the micro air pump according to Embodiment III of the present invention.
Figure 14:
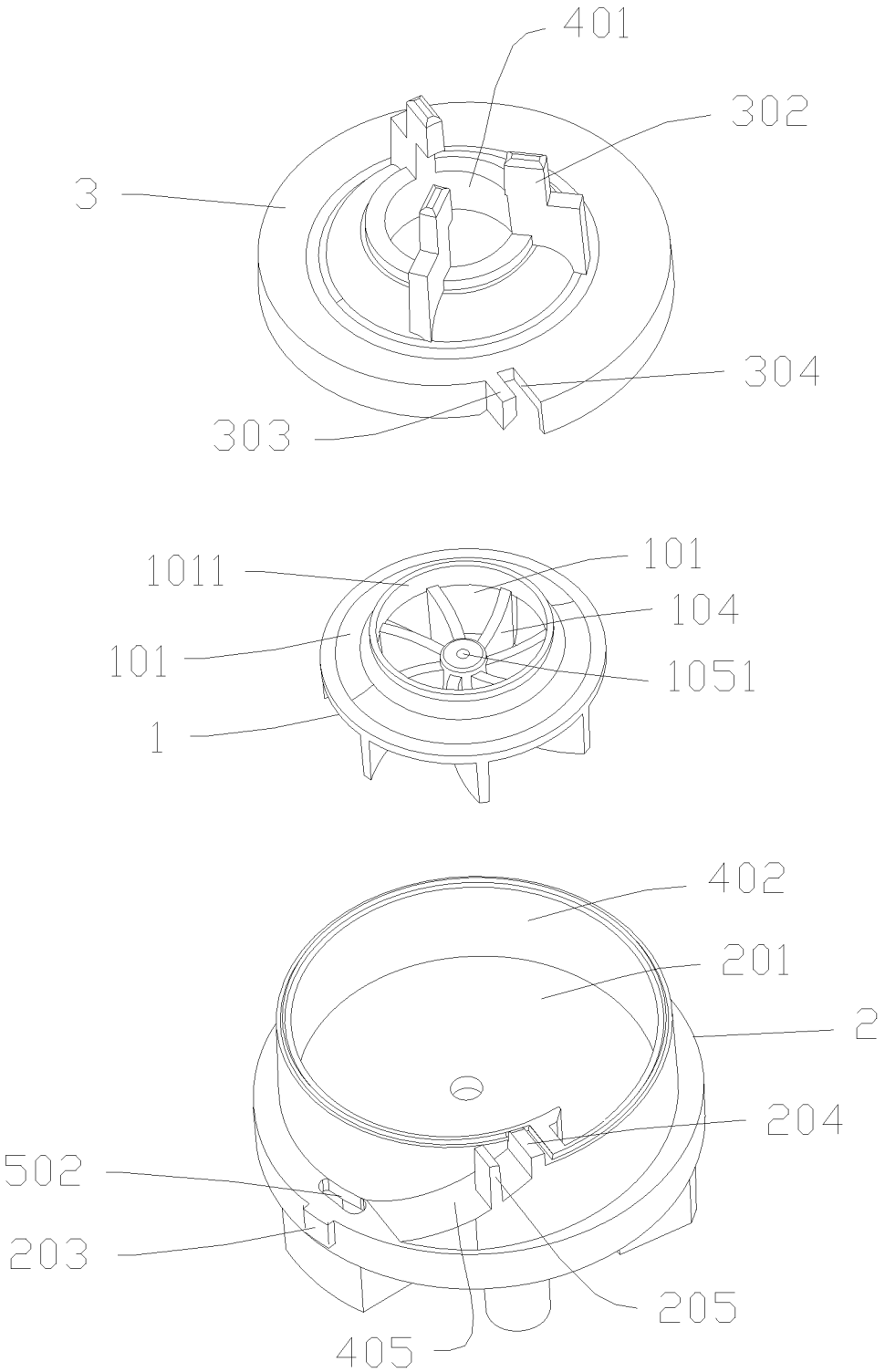
FIG. 14 is an exploded view showing a centrifugal impeller, an impeller mounting seat, and an impeller cover in the micro air pump according to Embodiment III of the present invention.
Figure 15:
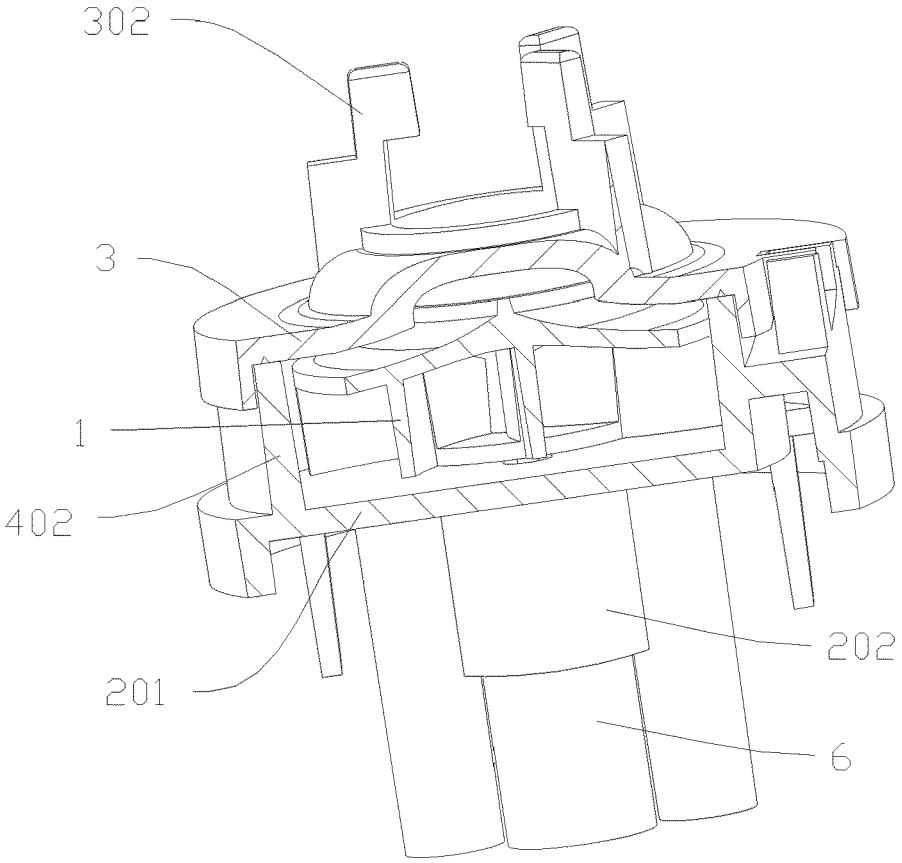
FIG. 15 is a cross-sectional view showing a partial structure of the micro air pump according to Embodiment III of the present invention.
Figure 16:
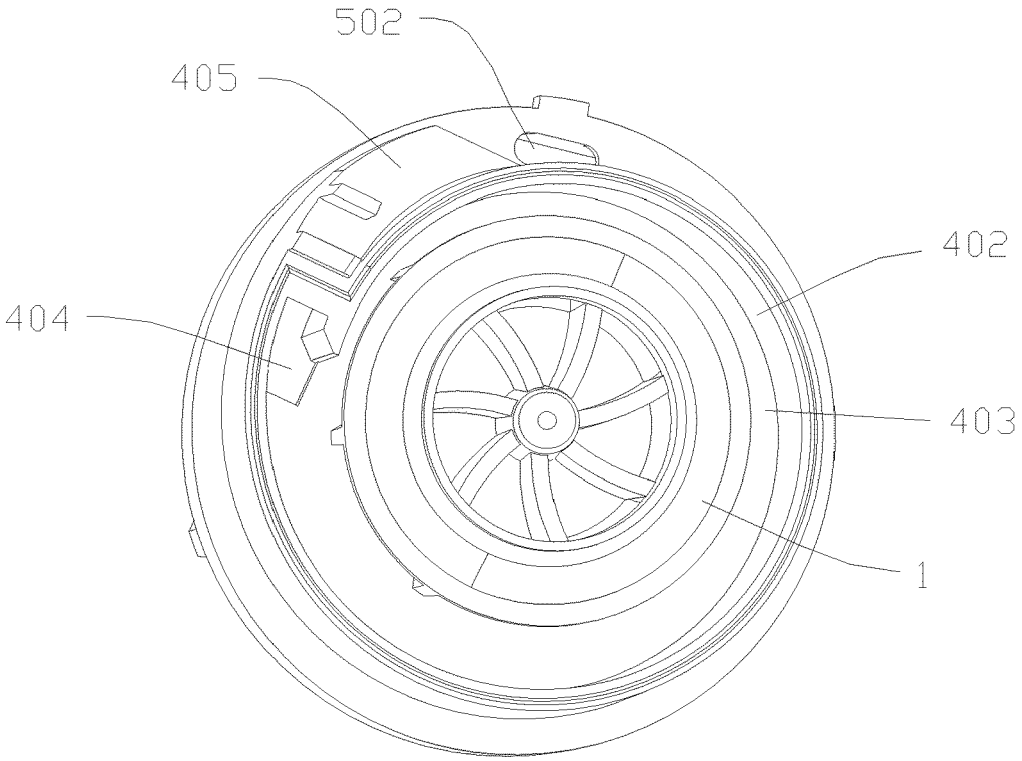
FIG. 16 is a perspective view of the centrifugal impeller and the impeller mounting seat in an assembled state according to Embodiment III of the present invention.
Figure 17:
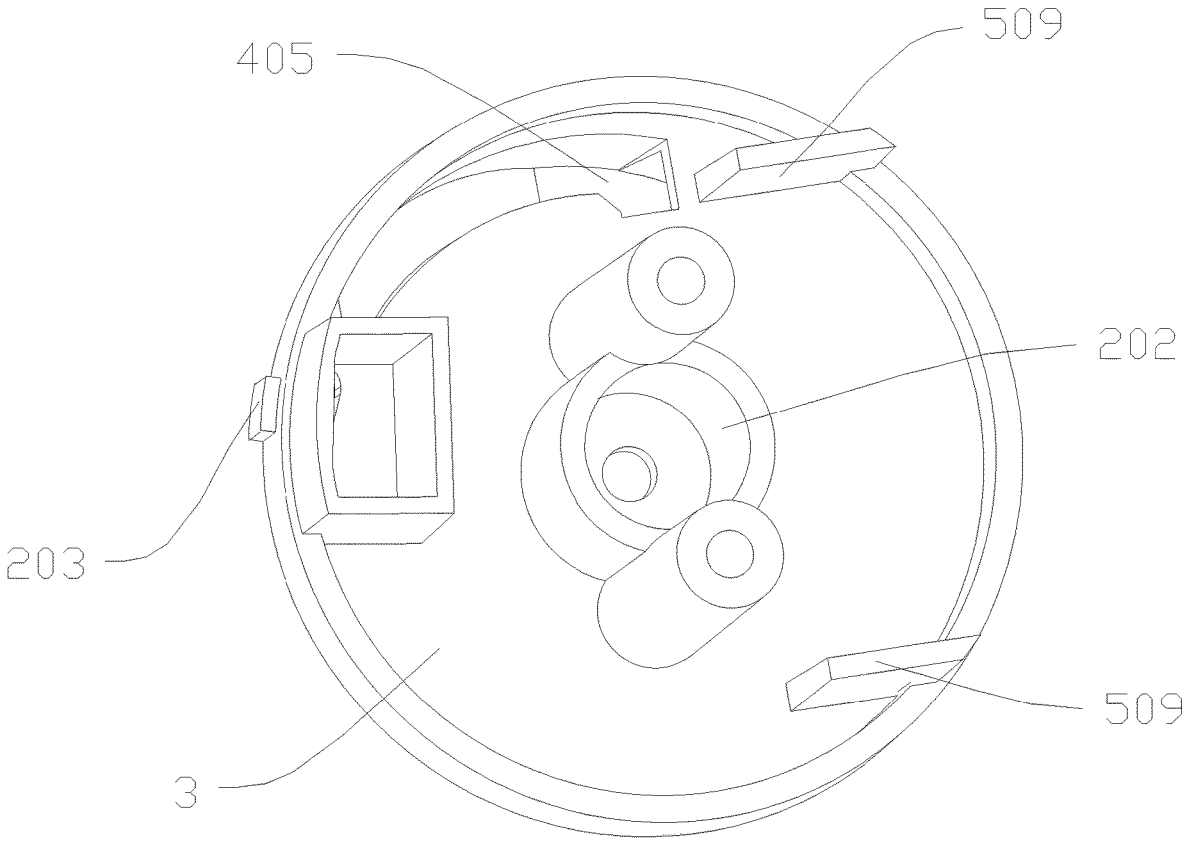
FIG. 17 is a perspective view of the impeller mounting seat according to Embodiment III of the present invention.
Figure 18:
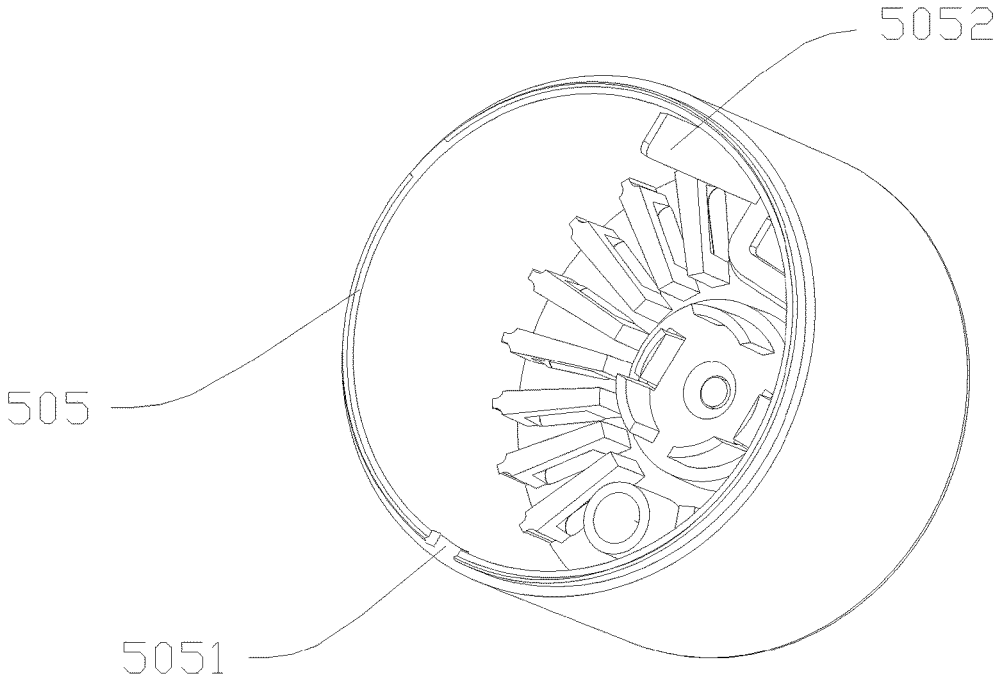
FIG. 18 is a perspective view of an air pump upper cover according to Embodiment III of the present invention.
Figure 19:
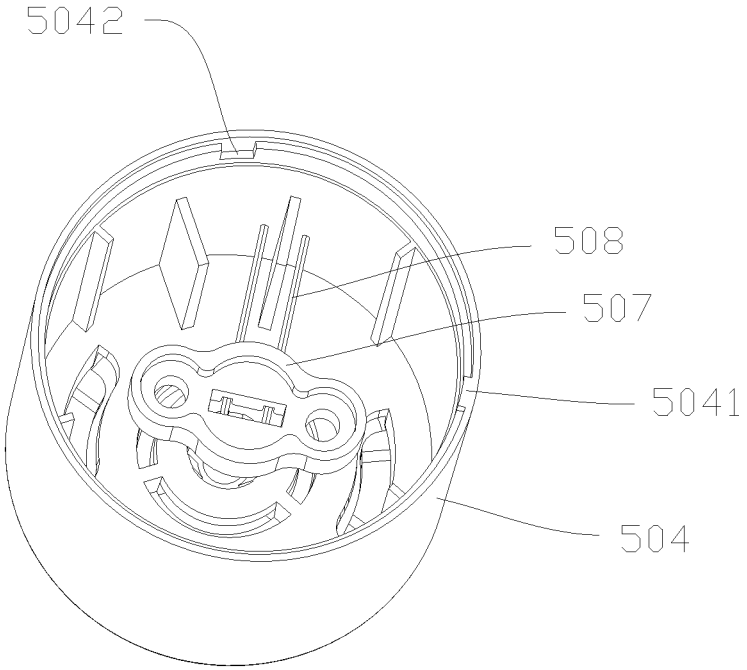
FIG. 19 is a perspective view showing a mounting structure of an air pump lower shell and an electric motor locking plate according to Embodiment III of the present invention.
Figure 20:
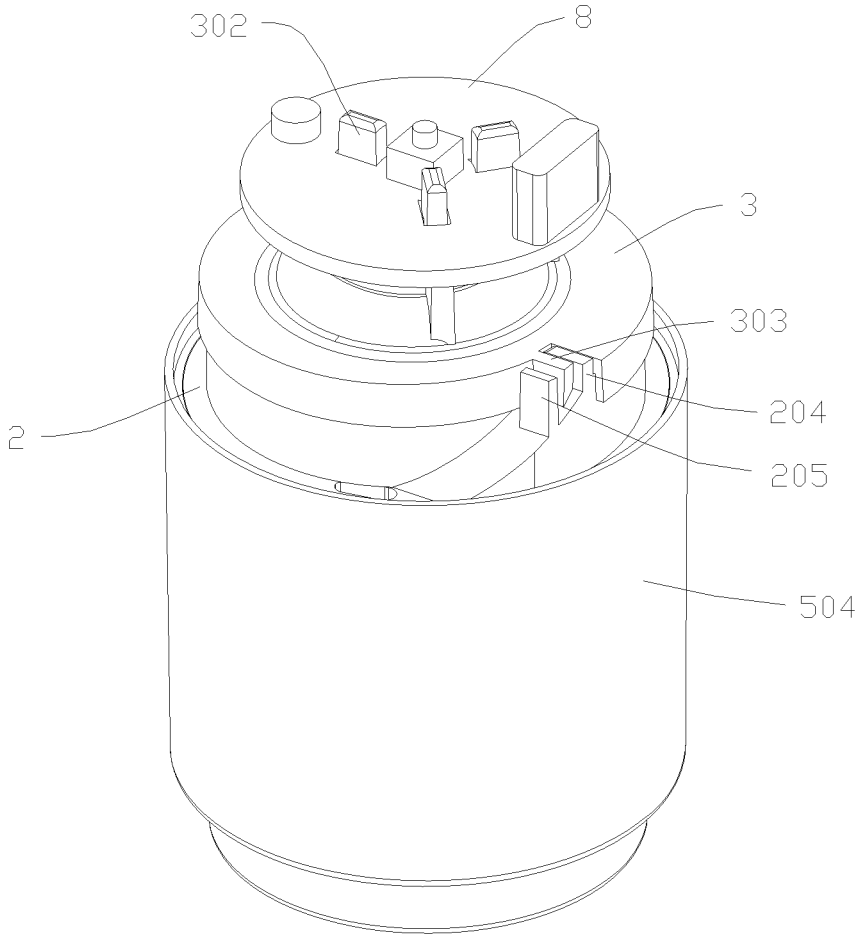
FIG. 20 is a perspective view of a partial structure of the micro air pump according to Embodiment III of the present invention, showing a mounting structure of a circuit board and a circuit board mounting frame and a mounting structure of the impeller mounting seat and the air pump lower shell.
Figure 21:
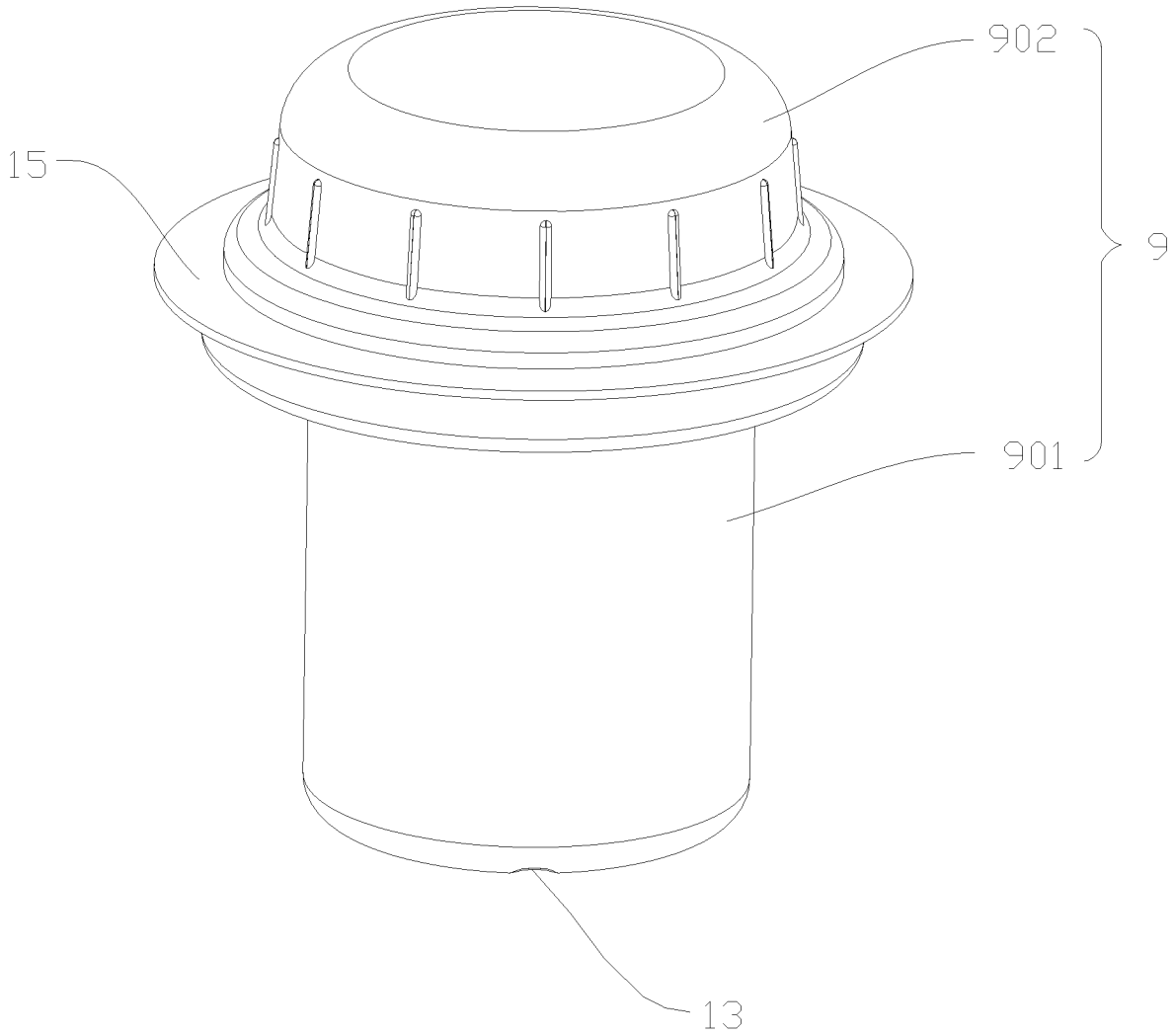
FIG. 21 is a perspective view showing an overall structure of a waterproof air pump according to Embodiment III of the present invention.
Figure 22:
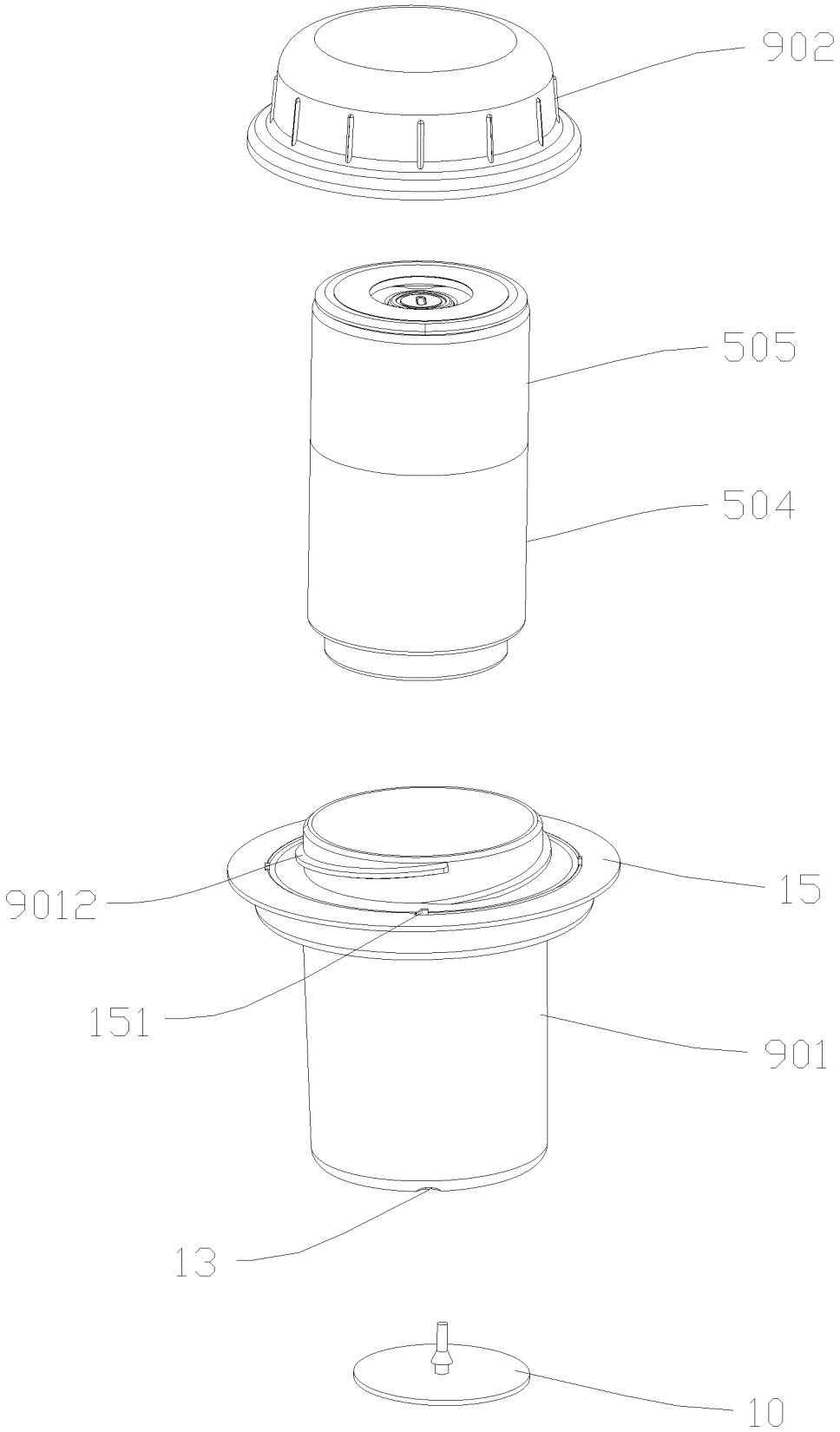
FIG. 22 is an exploded view of the waterproof air pump according to Embodiment III of the present invention.
Figure 23:
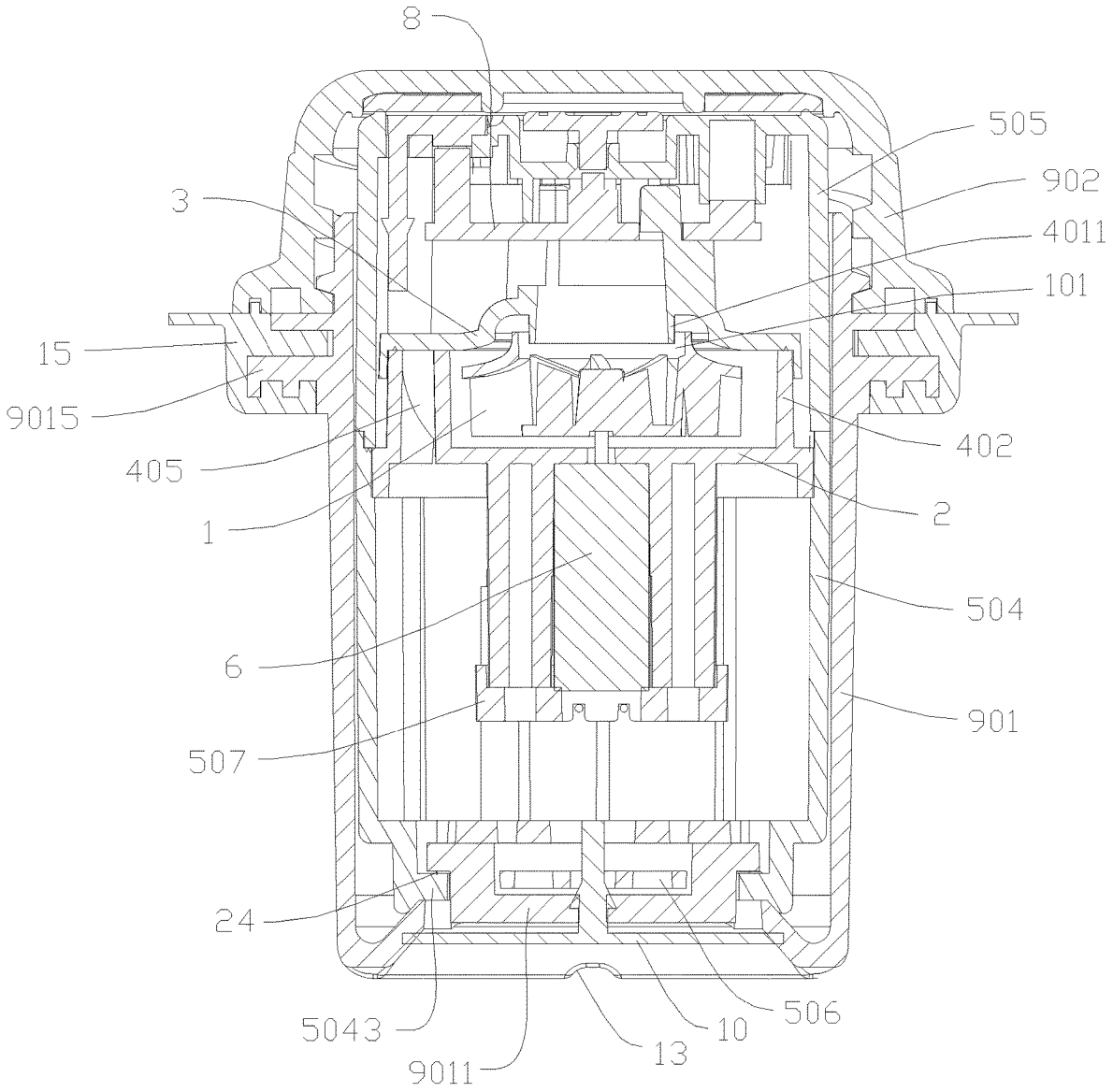
FIG. 23 is a cross-sectional view of the waterproof air pump according to Embodiment III of the present invention.
Figure 24:
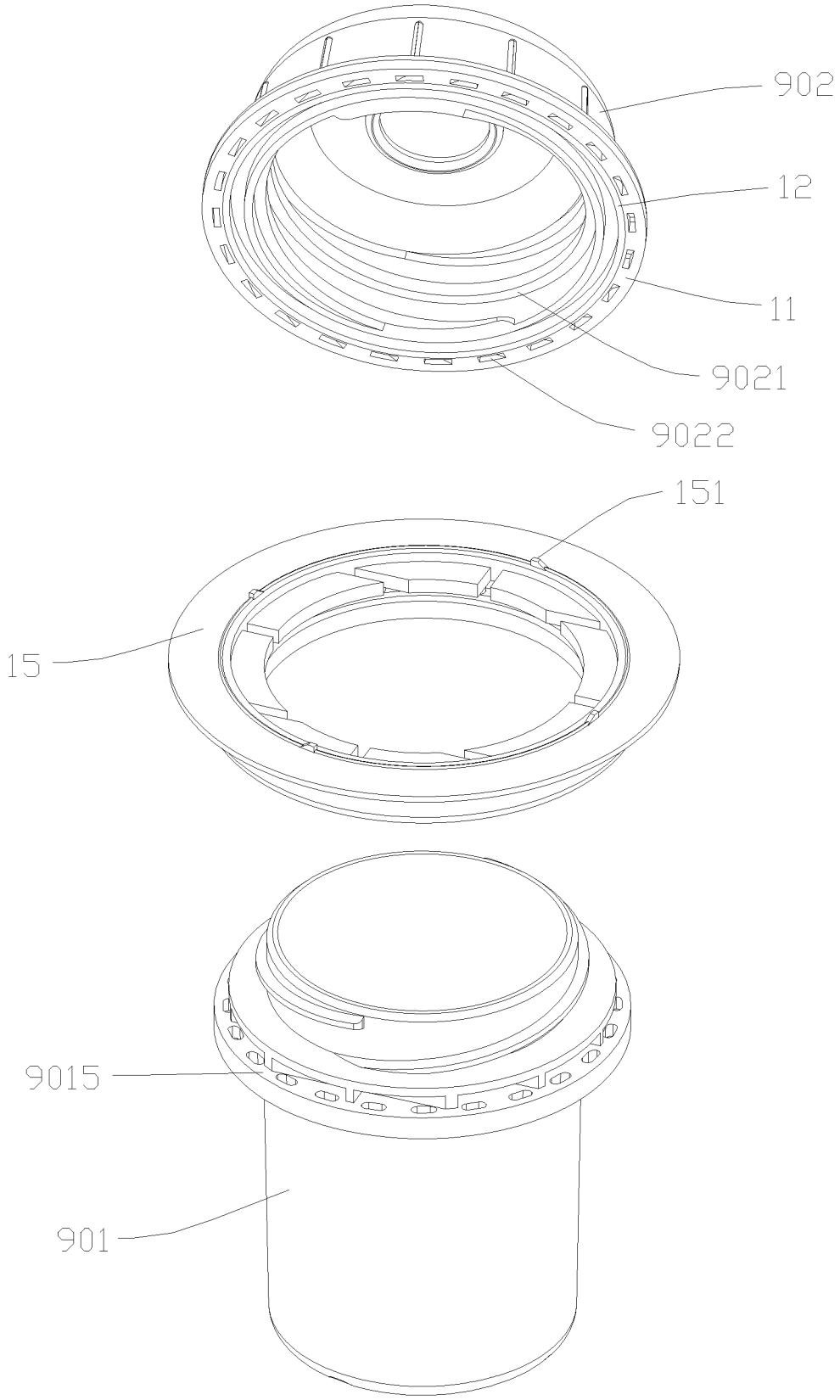
FIG. 24 is an exploded view of a partial structure of the waterproof air pump according to Embodiment III of the present invention.
Figure 25:
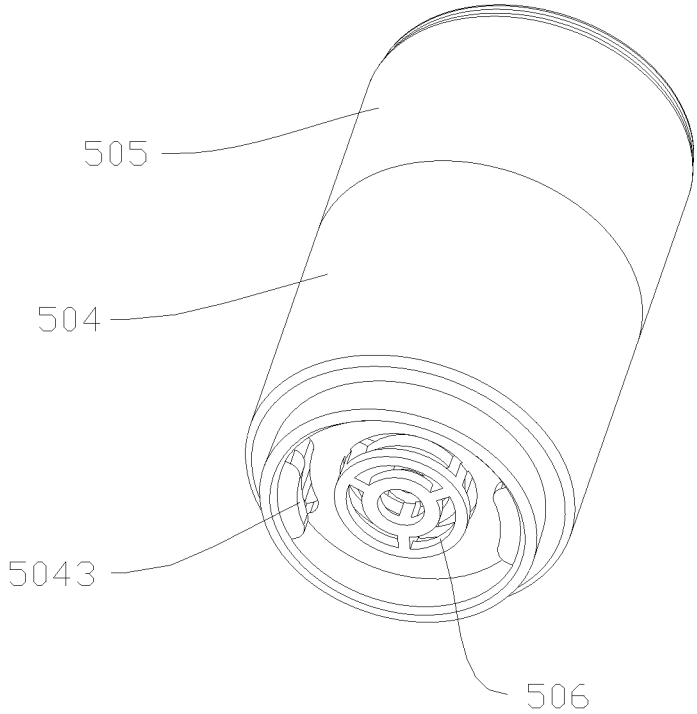
FIG. 25 is a perspective view showing the mounting structure of the micro air pump according to Embodiment III of the present invention at a second angle of view.
Figure 26:
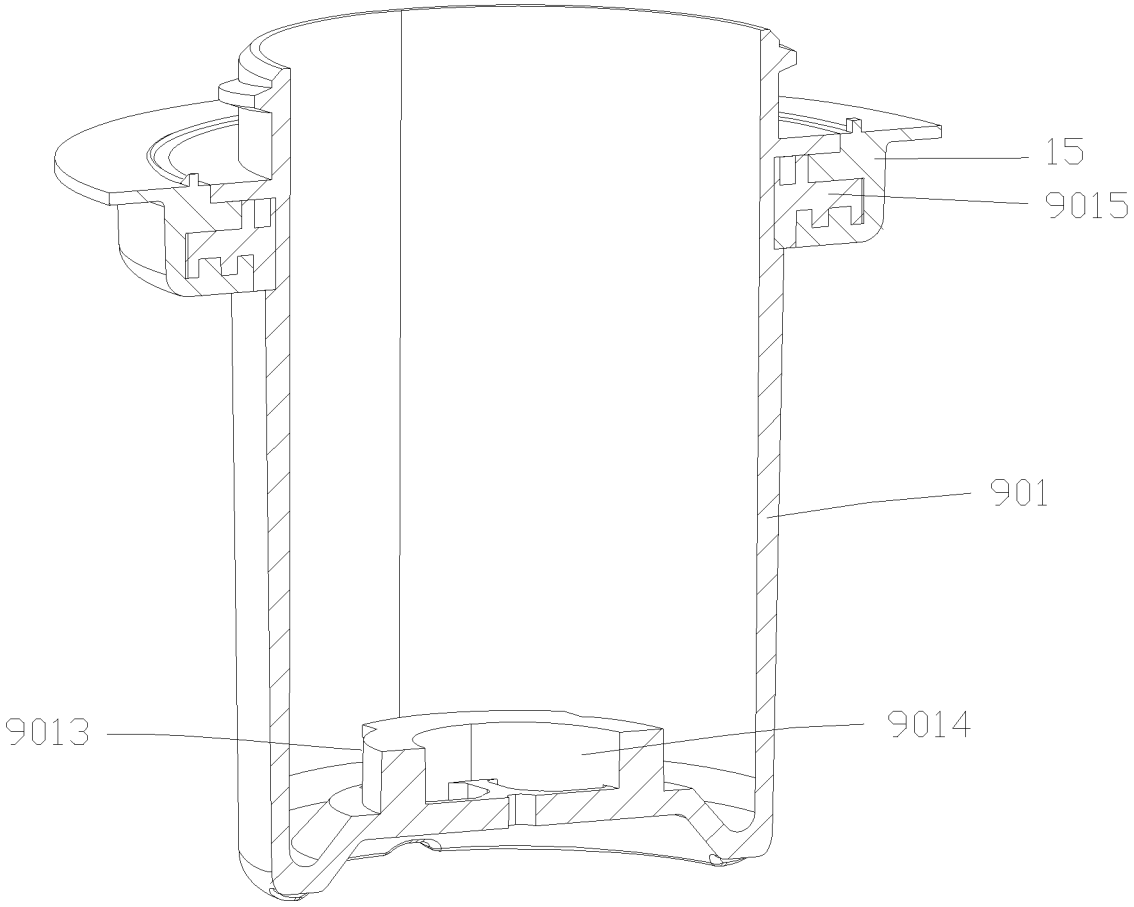
FIG. 26 is a cross-sectional view of the lower shell body according to Embodiment III of the present invention.
Figure 27:
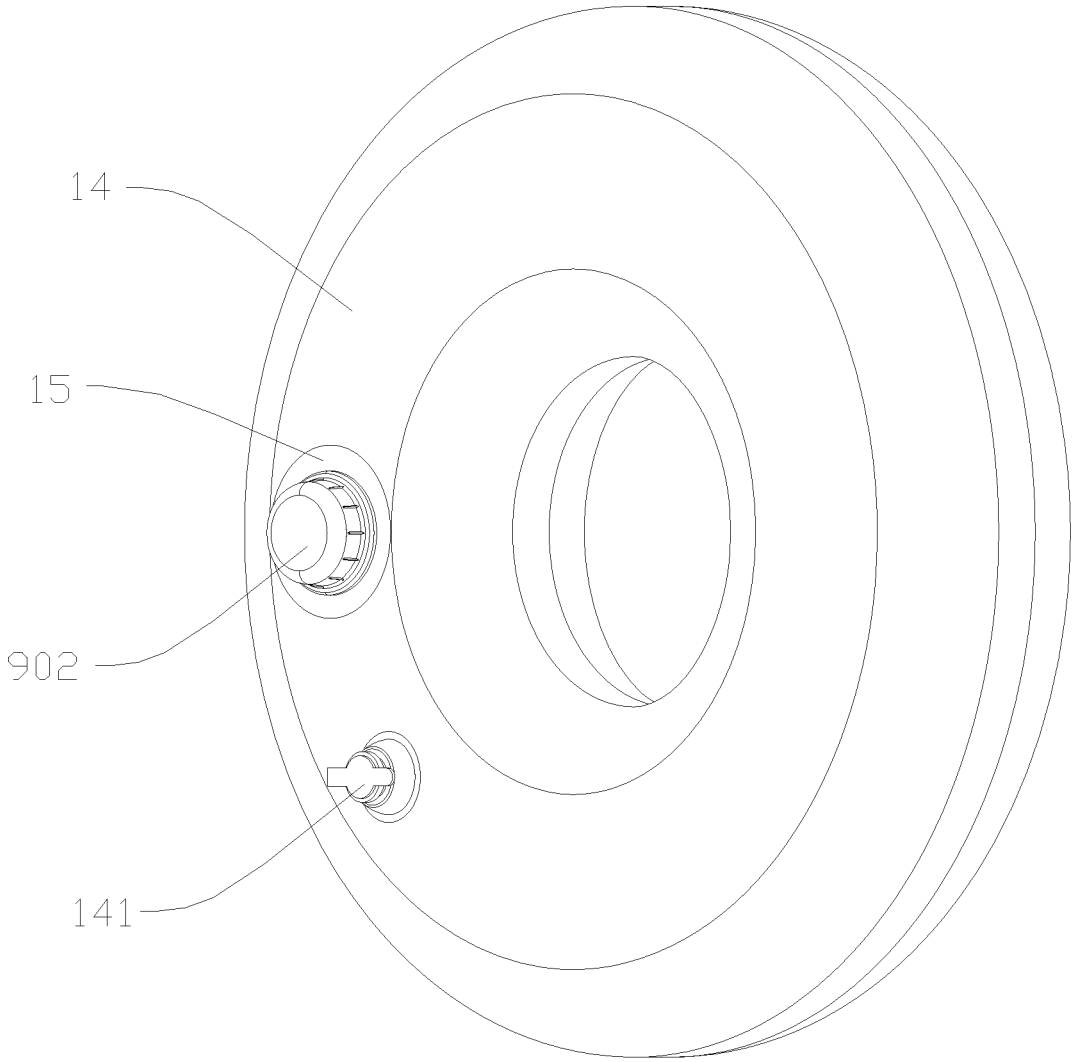
FIG. 27 is a perspective view of an inflatable swim ring according to Embodiment III of the present invention.

As shown in the FIG. 10 and FIG. 11, this embodiment differs from the Embodiment I in that the micro air pump further includes the air pump exterior shell 5. The shell body is a part of the air pump exterior shell 5. The air pump exterior shell 5 is provided with the assembly chamber 503 beneath the air chamber 4. The sidewall of the assembly chamber 503 is provided with the first air outlet 501. The tangent air outlet 404 communicates with the assembly chamber 503 to communicate with the first air outlet 501. The air deflecting boards 405 are arranged above and beneath the tangent air outlet 404, respectively. The air deflecting boards 405 are obliquely arranged from top to bottom along with the direction of the air flowing out. By arranging the oblique air deflecting boards 405 at the tangent air outlet 404, performances concerning guiding and gathering the air has been improved, and the airflows are guided to flow out of the air chamber 4 from the tangent air outlet 404 more smoothly and efficiently, which further speeds up the flowing of the air and improves the aspirating efficiency.

The electric motor 6 is arranged inside the assembly chamber 503. The lithium battery 7 and the circuit board 8 are further arranged inside the assembly chamber 503. When the micro air pump is working, the air is received by the air inlet 401 and is pumped into the assembly chamber 503 from the tangent air outlet 404. Since the first air outlet 501 of the micro air pump is arranged at the assembly chamber 503, the air that is guided into the assembly chamber 503 can flow inside the assembly chamber 503, and the heat of the electric motor 6, the lithium battery 7, the circuit board 8, and other components is released from the first air outlet 501, which cools and lengthens the service life of the air pump.

Embodiment III

As shown in the FIGS. 12 to 27, this embodiment differs from the Embodiment I in that the air-flow channel structure of the air pump of this embodiment has the air-guiding wall 402 directly formed by a sidewall of the impeller mounting seat 2. The impeller cover 3 is fitted with the air-guiding wall 402 in shape to be fastened above the air-guiding wall 402.

The micro air pump is an inflator pump, including the air-flow channel structure of the air pump, the air pump exterior shell 5, the electric motor 6, the circuit board 8, and the lithium battery 7. The electric motor 6 is a coreless motor, which is connected to and drives the centrifugal impeller 1 to rotate. The air pump exterior shell 5 includes the air pump lower shell 504 and the air pump upper cover 505. The air pump exterior shell 5 is provided with the first air inlets 506 and the first air outlet 501. The first air inlets 506 are air inlet meshes, which is provided on the air pump upper cover 505. The first air outlet 501 is arranged at the bottom of the air pump lower shell 504. The shell body is provided inside the air pump exterior shell 5. The air pump lower shell 504, the air pump upper cover 505, and the impeller mounting seat 2 are removably assembled with each other in a limiting and clamping manner. The impeller mounting seat 2 and the impeller cover 3 are removably assembled with each other in the limiting and clamping manner. One end of the air inlet 401 of the air chamber 4 communicates with the first air inlets 506 of the air pump exterior shell 5. The tangent air outlet 404 communicates with the first air outlet 501 of the air pump exterior shell 5. The air deflecting board 405 is arranged above the tangent air outlet 404. The air deflecting board 405 is obliquely arranged from top to bottom along with the direction of the air flowing out. Air enters in from the first air inlets 506 and flows to the axial-direction air inlet 101 of the centrifugal impeller 1 from the air inlet 401 on the impeller cover 3. The centrifugal impeller 1 radically blows air, and the air flows from the head end of the air-guiding channel 403 to the tail end of the air-guiding channel 403, flows out of the air chamber 4 from the tangent air outlet 404 and is exhausted from the first air outlet 501.

The impeller mounting seat 2 is provided with the ventilating hole 502 on the outside of the air-guiding wall 402. The ventilating hole 502 is configured to communicate with the first air outlet 501 and the outside and to provide an air inlet channel. In an inflating process of the air pump, when the inflatable product reaches an air-saturated state and the air pump is not turned off in time resulting in its continued inflating, it may cause the inflatable product to burst due to over-saturation. By arranging the ventilating hole 502, the present invention enables that excessive air is released from the ventilating hole 502 under air pressure, thus avoiding damage to the inflatable product caused by not turning off the air pump in time.

The circuit board 8 is electrically connected to the electric motor 6. The upper end of the impeller cover 3 is formed with the circuit board mounting frame 302, including three supporting blocks that extend upwards. The circuit board 8 is limited and clamped in the circuit board mounting frame 302 by the three through holes 81 arranged on the circuit boards 8, where the three through holes 81 match the three supporting blocks. A gap for air to flow in is kept between the circuit board 8 and the air inlet 401 on the impeller cover 3. Corresponding to the circuit board 8, the air pump upper cover 505 is provided with the switch button 16 and the charging port 17.

The impeller mounting seat 2 is further formed with the electric motor mounting slot 202 and the lithium battery position-limiting structure at the bottom of the impeller mounting seat 2. The upper part of the electric motor 6 is embedded inside the electric motor mounting slot 202, and the electric motor locking plate 507 is further connected to the lower part of the electric motor 6. The electric motor locking plate 507 is supported and arranged on the supporting rods 508 that are connected to the air pump lower shell 504 by a bottom positioning slot, and the electric motor locking plate 507 is configured to lock the electric motor 6 in longitudinal direction. The lithium battery position-limiting structure is the two position-limiting boards 509 that are connected beneath the impeller mounting seat 2 to limit the position of the lithium battery 7 in horizontal direction, and the lithium battery 7 is position-limited and arranged between the two position-limiting boards 509. The lithium battery 7 is vertically supported and arranged between the air pump lower shell 504 and the impeller mounting seat 2.

The air pump lower shell 504 and the air pump upper cover 505 are position-limited and clamped with each other by an embedded structure between the first lug 5041 and the first concave port 5051. The air pump lower shell 504 and the impeller mounting seat 2 are position-limited and clamped with each other by an embedded structure between the second concave port 5042 and the second lug 203. The top of the impeller mounting seat 2 is formed with the first position-limiting block 204 and the second position-limiting block 205. The stopper 303 is formed on the impeller cover 3. The position-limiting slot 304 is formed at one side of the stopper 303, and the position-limiting slot 304 can be fitted and clamped with the first position-limiting block 204. The impeller cover 3 is matched with the first position-limiting block 204 and is position-limited and clamped with the impeller mounting seat 2 by the position-limiting slot 304. The position-limiting inserting tab 5052 is formed inside the air pump upper cover 505. The position-limiting inserting tab 5052 can fit to be embedded between the second position-limiting block 205 and the other side of the stopper 303 and is position-limited and clamped with the impeller mounting seat 2. The air pump lower shell 504, the air pump upper cover 505, the impeller mounting seat 2, and the impeller cover 3 are removably assembled.

The waterproof air pump includes the waterproof exterior shell 9 and the micro air pump removably connected to the waterproof exterior shell 9 inside. The waterproof exterior shell 9 includes the lower shell body 901 and the waterproof upper cover 902. The lower shell body 901 is removably connected and relatively sealed to the waterproof upper cover 902 through a thread. The micro air pump is fastened to and removably connected to the lower shell body 901 by a screw fastening assembly. The bottom of the lower shell body 901 is formed with the second air outlet 9011. The second air outlet 9011 communicates with the first air outlet 501 of the micro air pump, and the second air outlet 9011 is connected to the one-way sealing valve piece 10, which can sufficiently avoid air leakage.

The interior wall of the waterproof upper cover 902 is provided with the interior thread 9021, and the exterior wall of the lower shell body 901 is provided with the exterior thread 9012 that matches the interior thread 9021. Each of the waterproof upper cover 902 and the lower shell body 901 is provided with the flat sealing surface 11. The flat sealing surface 11 of the waterproof upper cover 902 abuts against the flat sealing surface 11 of the lower shell body 901, and the seal ring 12 is arranged between the two flat sealing surfaces 11 to realize a seal between the waterproof upper cover 902 and the lower shell body 901. The threads are two threads largely spaced, which reduces the time and force required to screw tightly and avoids unintended loosening. When an air-saturation state is reached, the waterproof upper cover 902 can be screwed fast to realize a sealing effect.

The micro air pump is fastened with the lower shell body 901 by a screw fastening assembly. The screw fastening assembly includes the first guiding chute 9013 correspondingly arranged on the lower shell body 901 and the micro air pump, respectively, and the convexly arranged first fastening members 5043 that are matched with and rotatably fastened inside the first guiding chute 9013. The first guiding chute 9013 is arranged in the lower end of the lower shell body 901 and is arranged along the circumference of the lower shell body 901. The first fastening members 5043 are arranged at the lower end of the micro air pump. The first air outlet 501 of the micro air pump is cylindrical and arranged convexly downward the lower end. The upper end of the second air outlet 9011 of the lower shell body 901 is formed with the groove 9014 that matches the first air outlet 501 of the micro air pump in shape. The first air outlet 501 is embedded inside the groove 9014 and abuts against and communicates with the second air outlet 9011. The end surface of the bottom of the lower shell body 901 is formed with four ventilating slots 13 equally spaced. The ventilating slot 13 is radically arranged to traverse the end surface of the bottom of the lower shell body 901. One end of the ventilating slot 13 communicates with the second air outlet 9011, and the other end of the ventilating slot 13 communicates with the exterior part of the lower shell body 901.

An inflatable product includes the inflatable product body and the waterproof air pump. The inflatable product body is the inflatable swim ring 14, as shown in the FIG. 27. The exterior wall of the lower shell body 901 is sealingly connected to the inflatable swim ring 14 by the fused edge 15. The second air outlet 9011 is located at the interior cavity of the inflatable swim ring 14. The waterproof upper cover 902 is exposed on the exterior part of the inflatable swim ring 14. The inflatable swim ring 14 is further provided with the manual inflation and deflation valve 141.

The exterior wall of the lower shell body 901 is provided with the fused edge connecting slot seat 9015, and the fused edge 15 that is embedded and assembled with the fused edge connecting slot seat 9015. The fused edge 15 is configured to connect and seal the lower shell body 901 with the inflatable product. The upper end surface of the fused edge 15 is provided with several clamping blocks 151 along the circumference of the fused edge 15. The lower end surface of the waterproof upper cover 902 is provided with several clamping slots 9022 along the circumference of the waterproof upper cover 902. The clamping blocks 151 are clamped in the clamping slots 9022 to avoid loosening of the threads.

As shown in the FIGS. 12 to 27, the method for using the inflatable product in this embodiment is as follows: When the inflatable product needs to be inflated, the waterproof upper cover 902 is screwed off from the lower shell body 901. Meanwhile, the micro air pump is screwed and fastened to the lower shell body 901, and the micro air pump can be controlled to start by the switch button 16 to inflate the inflatable product. After the inflation is completed, the waterproof upper cover 902 is connected to the lower shell body 901 through a thread. When the waterproof air pump does not work, the inflatable product can be inflated through the manual inflation and deflation valve 141, which provides an emergency backup inflation method for the inflatable product. Additionally, the inflatable product can further be deflated fast through the manual inflation and deflation valve 141 to facilitate storing of the inflatable product. In addition, when the single micro air pump is configured with a plurality of inflatable products, the micro air pump is simply removed from the lower shell body 901 of the current inflatable product and is screwed and fastened to the lower shell body 901 of the inflatable product to be inflated. After the micro air pump is removed from the lower shell body 901, the first air outlet 501 of the micro air pump is connected to the air inlets of the other inflatable products through the air nozzle to inflate the other inflatable products.

Embodiment IV

Figure 28:
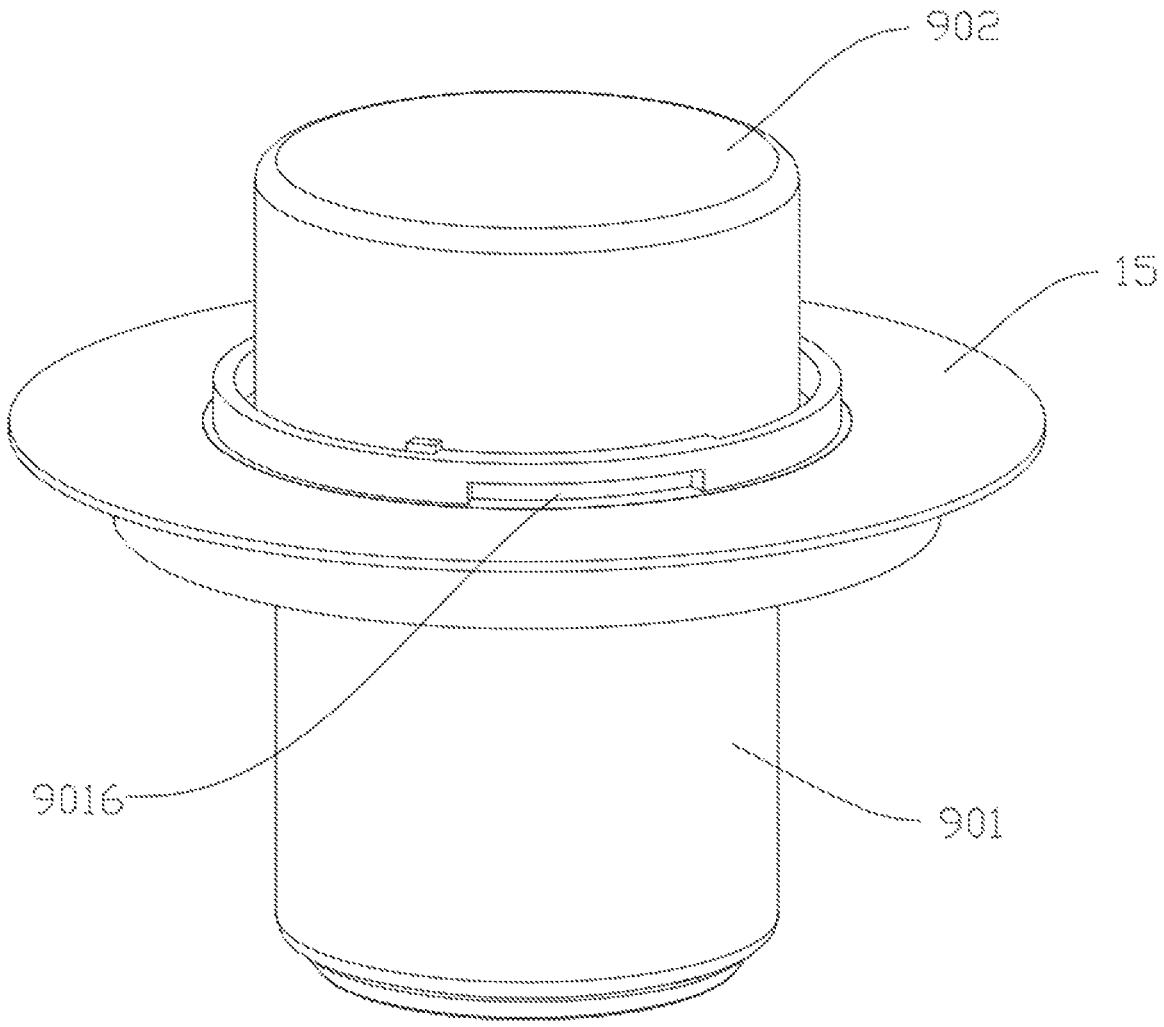
FIG. 28 is a perspective view of a waterproof air pump according to Embodiment IV of the present invention.
Figure 29:
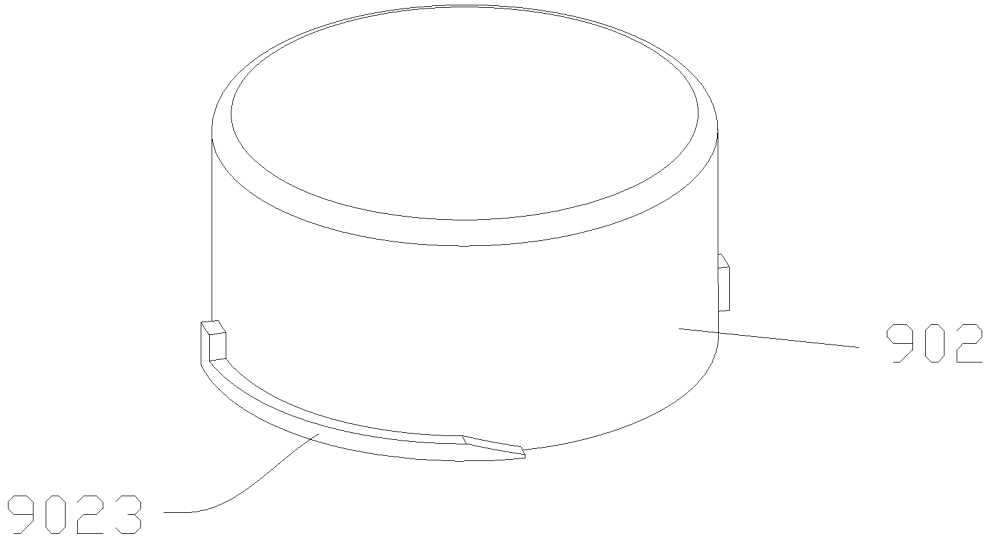
FIG. 29 is a perspective view of a waterproof upper cover according to Embodiment IV of the present invention.

As shown in FIG. 28 and FIG. 29, this embodiment differs from the Embodiment III in that the lower shell body 901 of the waterproof air pump and the waterproof upper cover 902 are fastened with each other by a screw fastening assembly, and the micro air pump and the lower shell body 901 are also fastened with each other by a screw fastening assembly. The lower shell body 901 and the waterproof upper cover 902 are relatively sealed by a seal ring arranged beneath the waterproof upper cover 902. The screw fastening assembly, which is configured to connect the lower shell body 901 and the waterproof upper cover 902, includes the second guiding chute 9016 arranged on the lower shell body 901 and the second fastening member 9023 convexly arranged on the waterproof upper cover 902.

The above descriptions are only four specific embodiments of the present invention, but the designs and ideas of the present invention are not limited herein. Any non-substantial modification of the present invention based on the ideas shall fall in the scope of protection of the present invention.

What is claimed is:

1. An air-flow channel structure for an air pump, the air-flow channel structure comprising a shell body and a centrifugal impeller;

wherein the shell body is formed with an air chamber, the air chamber is for accommodating the centrifugal impeller; the centrifugal impeller is arranged inside the air chamber; the air chamber is provided with an air inlet, the air inlet is arranged along an axial direction of the centrifugal impeller; the air inlet communicates with an axial-direction air inlet of the centrifugal impeller;

the air chamber is formed with an air-guiding wall inside the air chamber, wherein the air-guiding wall gradually expands in a spiral shape around an axis of the centrifugal impeller; a gap is provided between the air-guiding wall and the centrifugal impeller, and the gap forms an air-guiding channel; the air-guiding wall expands gradually away from the centrifugal impeller from a head end of the air-guiding channel to a tail end of the air-guiding channel;

the air chamber is provided with a tangent air outlet, the tangent air outlet is at the tail end of the air-guiding channel; the tangent air outlet communicates with the air-guiding channel and an exterior part of the air chamber; air flows to the axial-direction air inlet of the centrifugal impeller from the air inlet; and the centrifugal impeller radially blows air, the air flows from the head end of the air-guiding channel to the tail end of the air-guiding channel, and the air flows out of the air chamber from the tangent air outlet;

the shell body comprises an impeller mounting seat and an impeller cover; the impeller mounting seat and the impeller cover are sealingly connected with each other; the air chamber is formed between the impeller mounting seat and the impeller cover; the air inlet is arranged on the impeller cover; the impeller mounting seat is provided with a bottom baffle; and the air-guiding wall is connected onto the bottom baffle; and the impeller cover is provided with a step, wherein the step matches an outline of the air-guiding wall; and a surface of the step is a flared shape, wherein the flared shape concaves from an outer circumference towards a center.

2. The air-flow channel structure according to claim 1, wherein the centrifugal impeller comprises an upper cover board, a lower cover board, and a plurality of impeller blades, wherein the plurality of impeller blades are connected between the upper cover board and the lower cover board; and an external diameter of the lower cover board is shorter than an external diameter of the upper cover board.

3. The air-flow channel structure according to claim 2, wherein the external diameter of the lower cover board of the centrifugal impeller is at most a diameter of the axial-direction air inlet.

4. The air-flow channel structure according to claim 2, wherein a side of the air inlet extends downwards to form an extending edge, wherein the side faces towards the axial-direction air inlet of the centrifugal impeller; a side of the axial-direction air inlet of the centrifugal impeller extends upwards to form a ring boss, wherein the side faces towards the air inlet; and the extending edge protrudes into the ring boss.

5. The air-flow channel structure according to claim 4, wherein the upper cover board is obliquely arranged gradually upwards from an outer side to an inner side radially; each of the plurality of impeller blades extends to a center shaft from an edge of the outer side of the upper cover board to the inner side, and each of the plurality of impeller blades extends upwards to protrude into the ring boss;

an upper end surface of each of the plurality of impeller blades gradually goes upwards obliquely along with the upper cover board, wherein each of the plurality of impeller blades is located in a section from the edge of the outer side of the upper cover board to the ring boss; and the upper end surface of each of the plurality of impeller blades gradually go downwards obliquely, wherein each of the plurality of impeller blades is located in a section from the ring boss to the center shaft.

6. The air-flow channel structure according to claim 1, wherein an air deflecting board is arranged above the tangent air outlet; and the air deflecting board is obliquely arranged from top to bottom along with a direction of air flowing out.

7. A micro air pump, comprising the air-flow channel structure according to claim 1.

8. The micro air pump according to claim 7, further comprising an air pump exterior shell, and an electric motor;

wherein the electric motor is connected to the centrifugal impeller and the electric motor drives the centrifugal impeller; the shell body is provided inside the air pump exterior shell, or the shell body is a part of the air pump exterior shell; the air pump exterior shell is provided with a first air inlet and a first air outlet; one end of the air inlet of the air chamber communicates with the first air inlet of the air pump exterior shell; and the tangent air outlet communicates with the first air outlet of the air pump exterior shell.

9. The micro air pump according to claim 8, wherein the micro air pump is further provided with a ventilating hole; and the ventilating hole is configured to communicate with the first air outlet and an outside and the ventilating hole is configured to provide an air inlet channel and an air outlet channel.

10. The micro air pump according to claim 9, wherein the impeller mounting seat is provided with the ventilating hole on an exterior side of the air-guiding wall.

11. The micro air pump according to claim 9, wherein the impeller cover extended upwards to form an air inlet sidewall at the air inlet, and the air inlet sidewall is provided with the ventilating hole.

12. The micro air pump according to claim 8, wherein the electric motor is a coreless electric motor.

13. The micro air pump according to claim 8, wherein the air pump exterior shell comprises an air pump lower shell and an air pump upper cover; the first air inlet is provided on the air pump upper cover; the first air outlet is arranged on the air pump lower shell; the shell body is provided inside the air pump exterior shell;

the air pump lower shell, the air pump upper cover, and the impeller mounting seat are removably assembled with each other in a limiting and clamping manner; and the impeller mounting seat and the impeller cover are removably assembled with each other in the limiting and clamping manner.

14. The micro air pump according to claim 13, further comprising a circuit board;

wherein the circuit board is electrically connected to the electric motor; an upper end of the impeller cover is formed with a circuit board mounting frame; the circuit board is position-limited and clamped on the circuit board mounting frame; and a gap is kept between the circuit board and the air inlet of the impeller cover, wherein the gap is for the air to flow in.

15. The micro air pump according to claim 8, wherein the micro air pump is an inflator pump or an aspirator pump.

16. A waterproof air pump, comprising a waterproof exterior shell and the micro air pump according to claim 7, wherein the micro air pump is removably connected to the waterproof exterior shell inside;

the waterproof exterior shell comprises a lower shell body and a waterproof upper cover; the lower shell body is removably connected to the waterproof upper cover and the lower shell body is relatively sealed with the waterproof upper cover; the micro air pump is removably connected to the lower shell body; the lower shell body is formed with a second air outlet; and the second air outlet communicates with a first air outlet of the micro air pump.

17. The waterproof air pump according to claim 16, wherein the lower shell body is connected to the waterproof upper cover by a first thread or the lower shell body is fastened with the waterproof upper cover by a first screw fastening assembly; and the lower shell body is connected to the micro air pump by a second thread or the lower shell body is fastened with the micro air pump by a second screw fastening assembly.

18. An inflatable product, comprising an inflatable product body and the waterproof air pump according to claim 16;

wherein an exterior wall of the lower shell body is sealingly connected to the inflatable product body; the second air outlet is located at an interior cavity of the inflatable product body; and the waterproof upper cover is exposed on an exterior part of the inflatable product body.

* * * * *